US005310638A

United States Patent [19]

Shuto et al.

[11] Patent Number: 5,310,638

[45] Date of Patent: * May 10, 1994

[54] SILVER HALIDE COLOR PHOTOGRAPHIC MATERIAL COMPRISING AT LEAST ONE DIR-HYDROQUINONE COMPOUND, AND HAVING A TOTAL SILVER CONTENT OF LESS THAN 1.0 G/M$^2$

[75] Inventors: Sadanobu Shuto; Takashi Ozawa, both of Kanagawa, Japan

[73] Assignee: Fuji Photo Film Co., Ltd., Kanagawa, Japan

[ * ] Notice: The portion of the term of this patent subsequent to May 11, 2010 has been disclaimed.

[21] Appl. No.: 783,113

[22] Filed: Oct. 25, 1991

[30] Foreign Application Priority Data

Oct. 25, 1990 [JP] Japan ..... 2-287601
Oct. 26, 1990 [JP] Japan ..... 2-288894

[51] Int. Cl.$^5$ ..... G03C 1/46

[52] U.S. Cl. ..... 430/505; 430/544; 430/551; 430/957; 430/379

[58] Field of Search ..... 430/957, 379, 505, 544, 430/551

[56] References Cited

U.S. PATENT DOCUMENTS

| | | | |
|---|---|---|---|
| 4,770,982 | 9/1988 | Ichijima et al. | 430/957 |
| 5,011,764 | 4/1991 | Sakai et al. | 430/505 |
| 5,093,227 | 3/1992 | Nakazyo et al. | 430/372 |
| 5,210,012 | 5/1993 | Ono et al. | 430/544 |

FOREIGN PATENT DOCUMENTS

| | | |
|---|---|---|
| 0440195 | 1/1990 | European Pat. Off. . |
| 64546 | 1/1989 | Japan . |

*Primary Examiner*—Charles L. Bowers, Jr.
*Assistant Examiner*--Geraldine Letscher
*Attorney, Agent, or Firm*—Sughrue, Mion, Zinn, Macpeak & Seas

[57] ABSTRACT

A silver halide color photographic material comprises a support, a blue sensitive layer, a green sensitive layer and a red sensitive layer. The total silver content of the photographic material is not more than 1.0 g/m$^2$. The photographic material further contains a compound represented by the formula (1a) or (1b):

(1a)

(1b)

in which $R^{12}$ is an aliphatic group, an aromatic group or a heterocyclic group; M is —CO—, —$SO_2$—, —N($R^{15}$)CO—, —OCO— or —N($R^{15}$)$SO_2$—; each of $R^{14}$, $R^{15}$ and $R^{24}$ independently is hydrogen, an alkyl group or an aryl group; L is a divalent linking group necessary for forming a 5, 6 or 7-membered ring; each of $R^{11}$, $R^{13}$ and $R^{21}$ independently is hydrogen or a substituent group of the hydroquinone nucleus; Time is a group which is released from the oxidation product of the hydroquinone nucleus to further release X; X is a development inhibitor; and t is 0 or 1. M preferably is —$SO_2$—, —N($R^{15}$)CO—, —OCO— or —N($R^{15}$)$SO_2$—.

4 Claims, No Drawings

SILVER HALIDE COLOR PHOTOGRAPHIC MATERIAL COMPRISING AT LEAST ONE DIR-HYDROQUINONE COMPOUND, AND HAVING A TOTAL SILVER CONTENT OF LESS THAN 1.0 G/M$^2$

FIELD OF THE INVENTION

The present invention relates to a silver halide color photographic material, and particularly relates to a silver halide color reversal photographic material improved in the color and sharpness of an image.

BACKGROUND OF THE INVENTION

The silver halide color photographic materials usually comprises a support, a blue sensitive layer, a green sensitive layer and a red sensitive layer. In the image formation, the photographic material is imagewise exposed to light with respect to a multicolor object, and the silver halide is color-developed to form a color image of cyan, magenta, yellow or other colors.

A DIR (development inhibitor releasing) coupler has been known as an additive of a color negative film. A development inhibitor is released from the coupler in the color development process of a color photographic material. Using the DIR coupler, the sharpness of the image is improved by an edge effect, which is caused by the difference in the density of the released development inhibitor. The DIR coupler is effective in a color developing process of a color negative film or a color paper. However, the effect of the DIR coupler cannot be expected in other color photographic materials such as a color reversal film, a color reversal paper, and a black and white photographic material, since the main process in the image formation of these photographic materials is a black and white development.

A DIR-hydroquinone which releases a development inhibitor in the black and white development process has been known (cf., U.S. Pat. Nos. 3,364,022 and U.S. Pat. No. 3,379,529, and Japanese Patent Provisional Publications No. 50(1975)-62435, No. 50(1975)-133833, No. 51(1976)-51941, No. 50(1975)-119631, No. 52(1977)-57828, No. 62(1987)-103639 and No. 62(1987)-251746). The edge effect in the black and white development process can be obtained by the DIR-hydroquinone.

Further, Japanese Patent Provisional Publication No. 64(1989)-546 describes an image forming method improved in sharpness and graininess of the image. This method contains a black and white development process, and uses a silver halide photographic material containing a DIR-hydroquinone in a hydrophilic colloidal layer not containing silver halide.

However, these known DIR-hydroquinones are insufficient for increasing the sharpness of the image.

SUMMARY OF THE INVENTION

The applicants further studied the known DIR hydroquinones, and noted that these hydroquinones are not effective in a photographic material containing a relatively small amount of silver halide (the total silver content is not more than 1.0 g/m$^2$). The photographic material containing a small amount of silver halide has recently been proposed to reduce the amount of the desilvering solution.

A new DIR-hydroquinone represented by the following formula (1a) or (1b) has recently been proposed in European Patent Publication No. 0440195 published on Aug. 7, 1991. The European Patent Publication describes that the DIR-hydroquinone is contained in a silver halide emulsion layer.

This DIR-hydroquinone is excellent in the effect of increasing the sharpness of the image.

An object of the present invention is to provide a silver halide color photographic material containing a small amount of silver halide improved in the sharpness and the color reproducibility of the image.

Another object of the invention is to provide a photographic material which quickly forms a clear image.

There is provided by the present invention a silver halide color photographic material comprising a support, a blue sensitive layer, a green sensitive layer and a red sensitive layer, wherein the total silver content of the photographic material is not more than 1.0 g/m$^2$, and the photographic material further contains a compound represented by the formula (1a) or (1b):

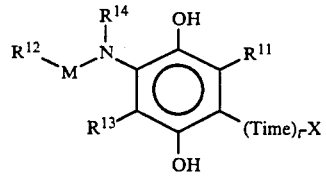

(1a)

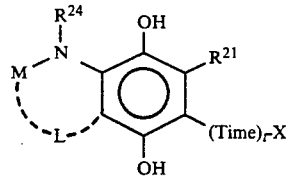

(1b)

in which $R^{12}$ is an aliphatic group, an aromatic group or a heterocyclic group; M is —CO—, —$SO_2$—, —N($R^{15}$)CO—, —OCO— or —N($R^{15}$)$SO_2$—; each of $R^{14}$, $R^{15}$ and $R^{24}$ independently is hydrogen, an alkyl group or an aryl group; L is a divalent linking group necessary for forming a 5, 6 or 7-membered ring; each of $R^{11}$, $R^{13}$ and $R^{21}$ independently is hydrogen or a substituent group of the hydroquinone nucleus; Time is a group which is released from the oxidation product of the hydroquinone nucleus to further release X; X is a development inhibitor; and t is 0 or 1.

The present inventors have surprisingly found that the DIR-hydroquinone represented by the formula (1a) or (1b) is effective in a photographic material containing a relatively small amount of silver halide. Accordingly, the silver halide color photographic material of the present invention forms a clear image improved in the sharpness and the color reproducibility.

In the photographic material of the present invention, the inter image effect is improved. There is difference between a color image formed by a multicolor exposure and that formed by a single-color exposure. This difference is mainly caused by immigration of a developing inhibitor between the silver halide emulsion layers. This phenomenon is referred to as "inter image effect" (cf., Hadson and Horten, *Journal of the Optical Society of America, vol.* 42, No. 9, pp 663-669, 1976). The inter image effect improves the sharpness and the color reproducibility of the image.

Further, the photographic material of the present invention quickly forms a clear image.

DETAILED DESCRIPTION OF THE INVENTION

The silver halide color photographic material of the present invention is characterized in the DIR-hydroquinone represented by the formula (1a) or (1b).

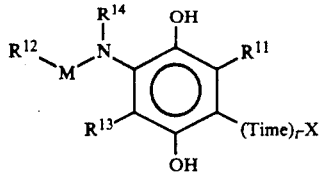

(1a)

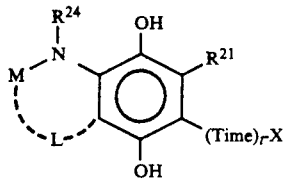

(1b)

In the formula (1a), $R^{12}$ is an aliphatic group, an aromatic group or a heterocyclic group. Examples of the aliphatic group include an alkyl group, an alkenyl group and an alkynyl group. The aliphatic group may have a straight chain, a branched chain or a cyclic chain. The aliphatic group preferably has 1 to 30 carbon atoms. Examples of the aromatic group include phenyl and naphthyl. The aliphatic group preferably has 6 to 30 carbon atoms. The heterocyclic group preferably has a 3-membered to 12-membered heterocyclic ring. The heterocyclic ring preferably contains nitrogen, oxygen or sulfur as the hetero atom.

In the formulas (1a) and (1b), M is —CO—, —$SO_2$—, —N($R^{15}$)CO—, —OCO— or —N($R^{15}$)—$SO_2$—. In the case that M in the formula (1a) is —CO—, the aliphatic group represented by $R^{12}$ is neither methyl nor an alkyl group having an hetero atom attached to the carbon atom adjacent to M. In the formula (1a) M preferably is —$SO_2$—, —N($R^{15}$)CO—, —OCO— or —N($R^{15}$)—$SO_2$—.

In the formulas (1a) and (1b), each of $R^{14}$, $R^{15}$ and $R^{24}$ independently is hydrogen, an alkyl group or an aryl group. Hydrogen is particularly preferred. The alkyl group may have a straight chain, a branched chain or a cyclic chain. The alkyl group preferably has 1 to 30 carbon atoms. Examples of the aryl group include phenyl and naphthyl. The aryl group preferably has 6 to 30 carbon atoms.

In the formula (1b), L is a divalent linking group necessary for forming a 5, 6 or 7-membered ring. Examples of the linking group include alkylene, alkenylene, arylene, oxyalkylene, oxyarylene, aminoaryleneoxy and an oxygen atom.

In the formulas (1a) and (1b), each of $R^{11}$, $R^{13}$ and $R^{21}$ independently is hydrogen or a substituent group of the hydroquinone nucleus.

In the formulas (1a) and (1b), each of $R^{11}$ and $R^{21}$ preferably is hydrogen, an alkylthio group, an arylthio group, an alkoxy group, an aryloxy group, an amido group, a sulfonamido group, an alkoxycarbonylamino group, an ureido group, a carbamoyl group, an alkoxycarbonyl group, a sulfamoyl group, a sulfonyl group, cyano, an acyl group, a heterocyclic group or a group represented by -(Time)$_t$-X. Each of $R^{11}$ and $R^{21}$ more preferably is hydrogen, an alkylthio group, an alkoxy group, an amido group, a sulfonamido group, an alkoxycarbonylamino group, an ureido group, a carbamoyl group, an alkoxycarbonyl group, a sulfamoyl group, cyano or a group represented by -(Time)$_t$-X.

In the formula (1a), $R^{13}$ preferably is hydrogen, an alkylthio group, an arylthio group, an alkoxy group, an aryloxy group, an amido group, a sulfonamido group, an alkoxycarbonylamino group, an ureido group or a group represented by -(Time)$_t$-X. $R^{13}$ more preferably is hydrogen, an alkylthio group, an alkoxy group, an amide group, a sulfonamide group, an alkoxycarbonylamino group, a ureido group or a group represented by -(Time)$_t$-X.

In the formulas (1a) and (1b), Time is a group which is released from the oxidation product of the hydroquinone nucleus to further release X, X is a development inhibitor, and t is 0 or 1.

The group represented by -(Time)$_t$-X is a group which is released as -(Time)$_t$-X only when an oxidation product is formed from the oxidation-reduction nucleus by a crossoxidation reaction in the development process.

The group represented by Time preferably contains sulfur, nitrogen, oxygen or selenium as a terminal atom which is attached to the hydroquinone nucleus.

Time may be a group capable of releasing X after the development process. Time may have a timing adjusting function. Further, Time may be a coupler which reacts with an oxidation product of a developing agent to release X. Furthermore, Time may be an oxidation-reduction group.

In the case that Time is a group having timing adjusting function, examples thereof are described in U.S. Pat. Nos. 2,248,962 and U.S. Pat. No. 4,409,323, U.K. Patent No. 2,096783, U.S. Pat. No. 4,146,396, and Japanese Patent Provisional Publications No. 51(1976)-146828 and No. (1982)-56837. Time may be a combination of two or more compounds selected from those described in the above publications.

Preferred examples of the timing adjusting group are described below.

(1) Group utilizing cleavage reaction of hemiacetal

This group is described in U.S. Pat. No. 4,146,396 and Japanese Patent Provisional Publications No. 60(1985)-249148 and No. 60(1985)-249149. The group is represented by the following formulas. In the following formula, the mark * indicates a position connecting to the left side in the formula (1a) or (1b), and the mark ** indicates a position connecting to the right side in the formula (1a) or (1b).

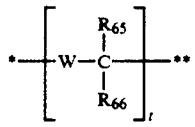

(T-1)

In the formula, W is oxygen, sulfur or —$NR_{67}$; each of $R_{65}$ and $R_{66}$ is hydrogen or a substituent group; $R_{67}$ is a substituent group; and t is 1 or 2. When t is 2, two of —W—C$R_{65}R_{66}$ may be different from each other. When each of $R_{65}$ and $R_{66}$ is a substituent group, examples of $R_{67}$ include $R_{69}$—, $R_{69}$CO, $R_{69}SO_2$—, $R_{69}NR_{70}$CO— and $R_{69}NR_{70}SO_2$—. $R_{69}$ is an aliphatic group, an aromatic group or a heterocyclic group, and $R_{70}$ is an aliphatic group, an aromatic group, a heterocyclic group or a hydrogen atom. Each of $R_{65}$, $R_{66}$ and $R_{67}$ is a divalent group, and two or more divalent groups represented by $R_{65}$, $R_{66}$ and $R_{67}$ may be combined with each other to form a cyclic structure.

(2) Group causing cleavage reaction utilizing intermolecular nucleophilic substitution reaction This group is described in U.S. Pat. No. 4,248,962. The group is represented by the following formula.

*-Nu-Link-E-** (T-2)

In the formula, the mark * indicates a position connecting to the left side in the formula (1a) or (1b), and the mark  indicates a position connecting to the right side in the formula (1a) or (1b). Nu is a nucleophilic group. Examples of the nucleophilic group include oxygen and sulfur. E is an electrophilic group, which is receives nucleophilic attack from Nu to cleave the bond at the mark . Link is a linking group to make three-dimensional relation between Nu end E so that Nu and E can react with each other to perform intermolecular nucleophilic substitution reaction.

(3) Group causing cleavage reaction utilizing electron moving reaction based on conjugation system This group is described in U.S. Pat. Nos. 4,409,323 and U.S. Pat. No. 4,421,845. The group is represented by the following formula.

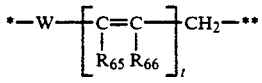
(T-3)

In the formula, the mark *, the mark **, W, $R_{65}$, $R_{66}$ and t have the same meanings as defined on the formula (T-1).

(4) Group utilizing cleavage reaction caused by hydrolysis of ester

The group is a linking group described in West German Patent Publication No. 2,626,315. Examples of the group are represented by the following formulas. In the following formulas, the mark * and the mark ** have the same meanings as defined on the formula (T 1).

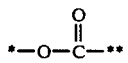
(T-4)

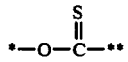
(T-5)

(5) Group utilizing cleavage reaction of iminoketal

The group is a linking group described in U.S. Pat. No. 4,546,073. The group is represented by the following formula

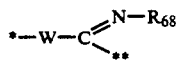
(T-6)

In the formula, the mark *, the mark ** and W have the same meanings as defined in the formula (T-1), and $R_{68}$ has the same meaning as that of $R_{67}$.

When Time is a coupler, preferred examples of the coupler are represented by the following formulas (C-1) to (C-4).

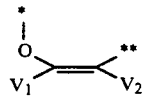
(C-1)

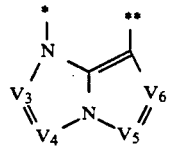
(C-1)

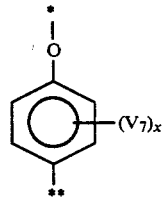
(C-3)

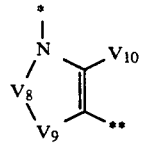
(C-4)

In the formulas, each of $V_1$ and $V_2$ is a substituent group; each of $V_3$, $V_4$, $V_5$ and $V_6$ is nitrogen or a substituted or unsubstituted methine group; $V_7$ is a substituent group, x is an integer of 0 to 4; when x is 2 or more, the groups represented by $V_7$ may be different from each other; and two of $V_7$ may be connected to each other to form a cyclic structure. $V_8$ is —CO—, —$SO_2$—, oxygen or a substituted imino group. $V_9$ is a non-metallic atom group for forming a 5-membered to 8-membered cyclic ring together with the group represented by

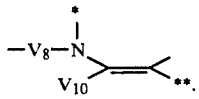

is hydrogen or a substituent group.

In the case that the group represented by Time in the formula (1a) or (1b) is an oxidation reduction group, Time is preferably represented by the following formula (R-1).

*—P—(Y=Z) $_l$—Q—B (R-1)

In the formula, each of P and Q independently is oxygen or a substituted or unsubstituted imino group; at least one of Y and Z is a methine group having X as a substituent group; each of other Y and Z is a substituted or unsubstituted methine group or nitrogen; l is an integer of 1 to 3 (the groups represented by Y and X may be different from each other); and B is hydrogen or a group capable of being removed by alkali. Any two substituent groups of P, Y, Z, Q and B become divalent groups and may be combined with each other to form a cyclic structure. For example, the groups represented by $(Y{=}Z)_l$ may form benzene ring or pyridine ring.

In the case that each of P and Q is a substituted or unsubstituted imino group, a preferred example is an imino group substituted with a sulfonyl group or an acyl group.

In this case, P and Q are represented as follows.

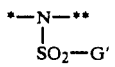

(N-1)

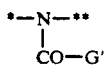

(N-2)

In the formulas, the mark * is a position to connect to hydroquinone mother nucleus in the case of P, and is a position to connect to B in the case of Q. The mark ** is a position to connect to one of free bonding hands of the group represented by $-(Y{=}Z)_1-$.

In the formulas, the group represented by G' is an aliphatic group, an aromatic group or a heterocyclic group.

As the group represented by the formula (R-1), preferred are those represented by the following formula (R-2) or the following formula (R-3).

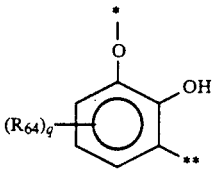

(R-2)

-continued

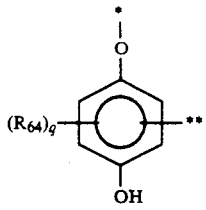

(R-3)

In the formulas, the mark * is a position to connect to hydroquinone mother nucleus, and the mark ** is a position to connect to X.

$R_{64}$ is a substituent group, and q is an integer of 0, or 1 to 3. When q is two or more, the groups represented by $R_{64}$ may be different from each other. Further, when two of $R_{64}$ are substituent groups on the adjacent carbon atoms, they may be divalent groups which are combined with each other to form a cyclic structure.

In the formulas (1a) and (1b), preferred examples of X include mercaptoazoles and benzotriazoles. With respect to mercaptoazoles, mercaptotetrazsoles, 5-mercapto-1,3,4-thiazoles and 5-mercapto-1,3,4-oxadiazoles are more preferred. Most preferred is 5-mercapto-1,3,4-thiazole.

Examples of the DIR-hydroquinone represented by the formula (1a) or (1b) are shown below.

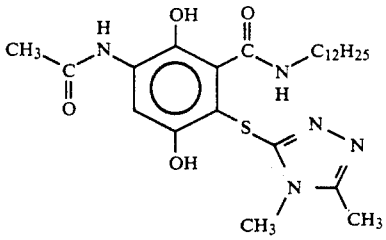

(1a-1)

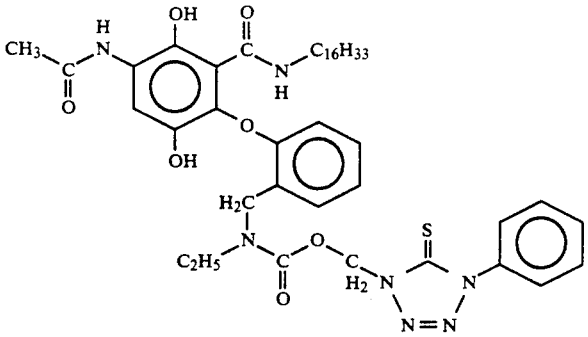

(1a-2)

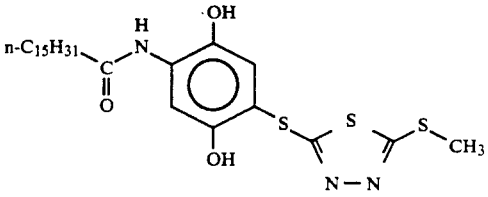

(1a-3)

-continued
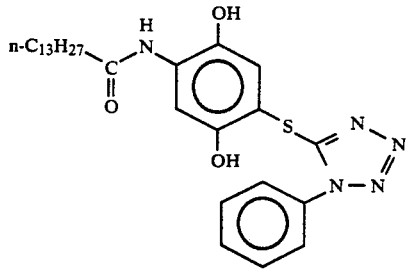
(1a-4)
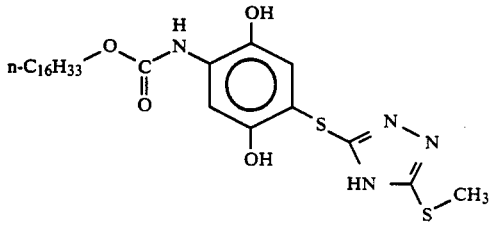
(1a-5)
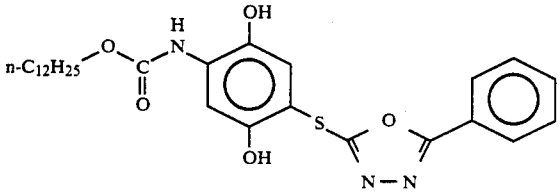
(1a-6)
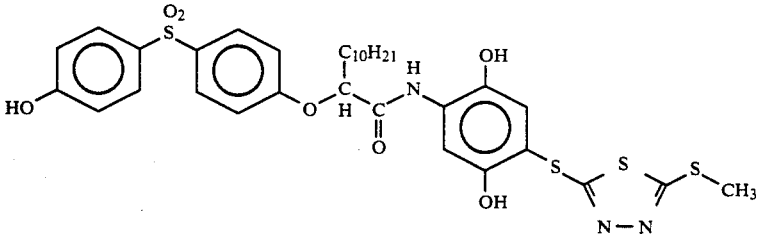
(1a-7)
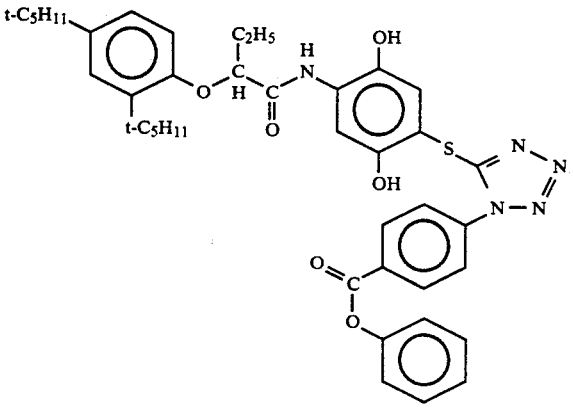
(1a-8)

-continued
(1a-9)
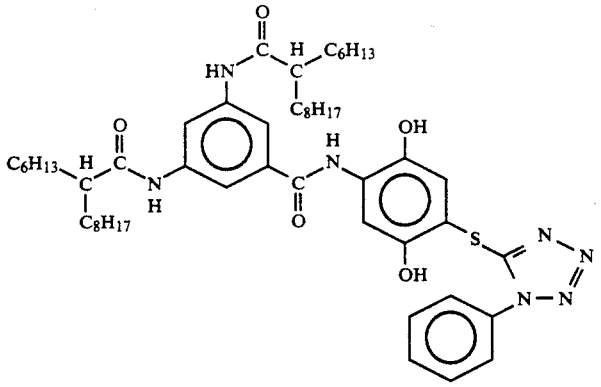
(1a-10)
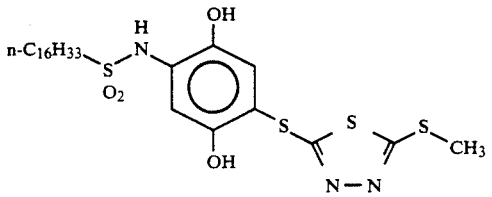
(1a-11)
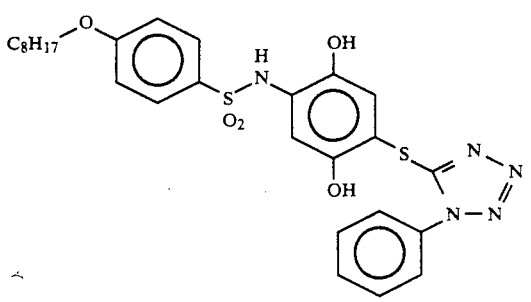
(1a-12)
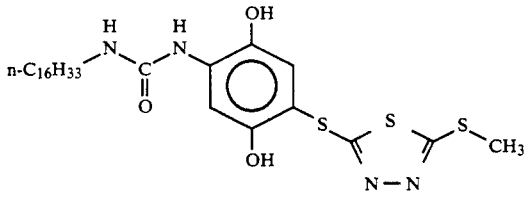
(1a-13)
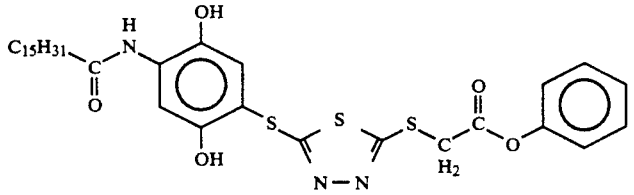
(1a-14)
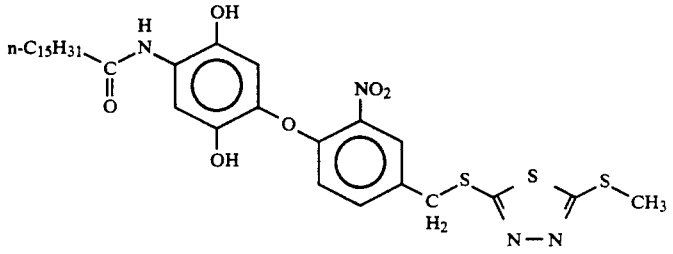

-continued
(1a-15)
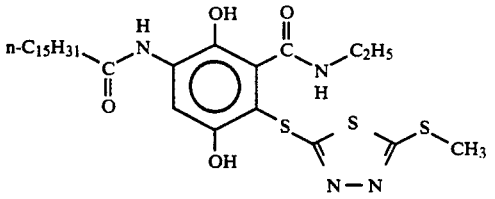
(1a-16)
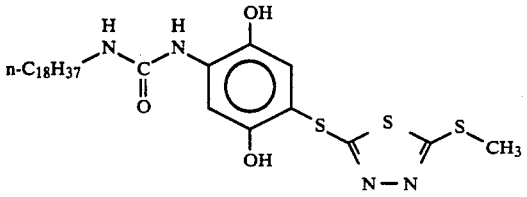
(1a-17)
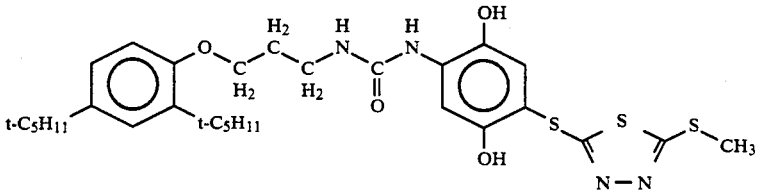
(1a-18)
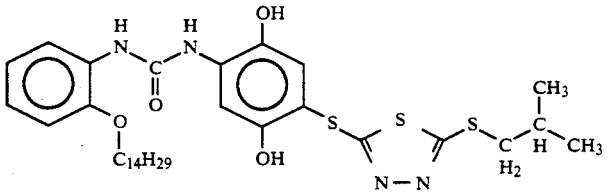
(1a-19)
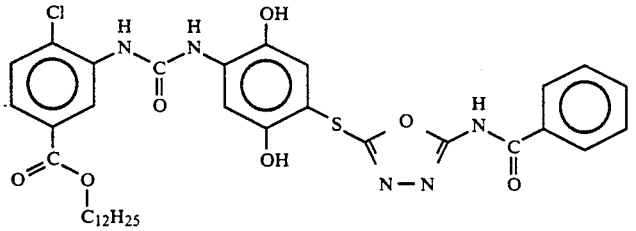
(1a-20)
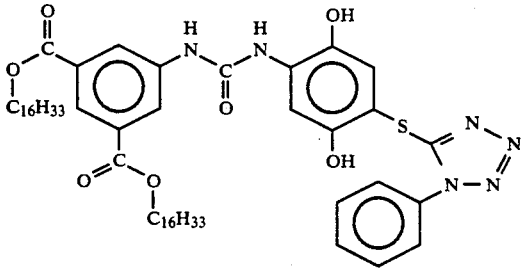
(1a-21)
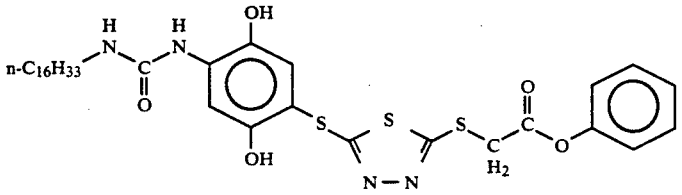

-continued
(1a-22)
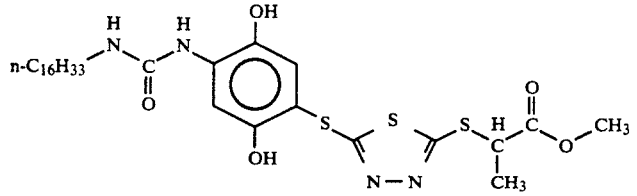
(1a-23)
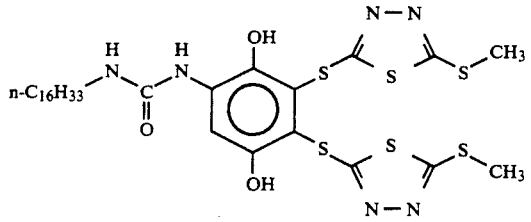
(1a-24)
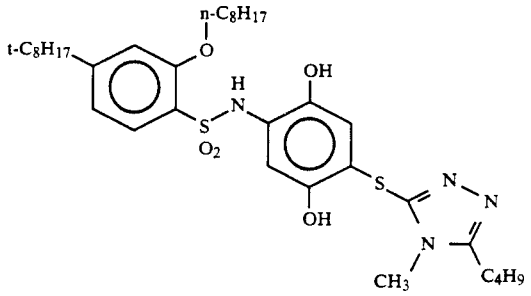
(1a-25)
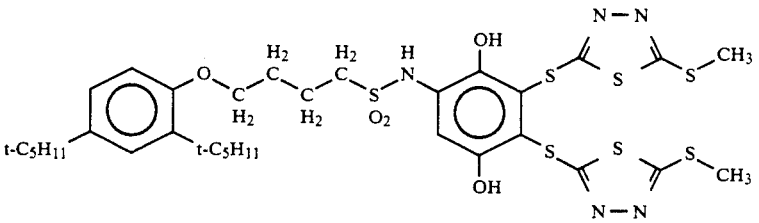
(1a-26)
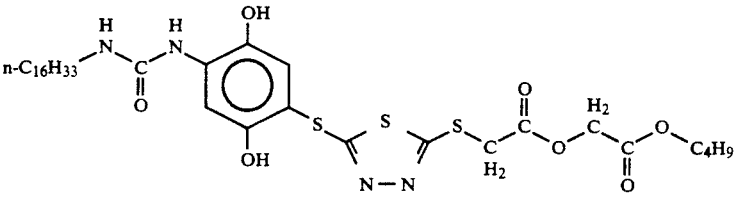
(1a-27)
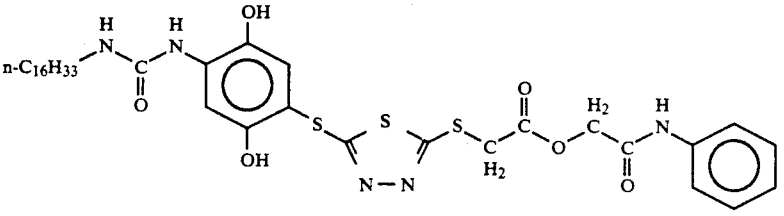

-continued
(1a-28)
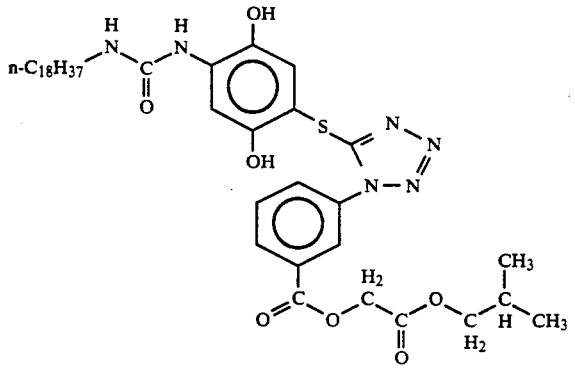
(1a-29)
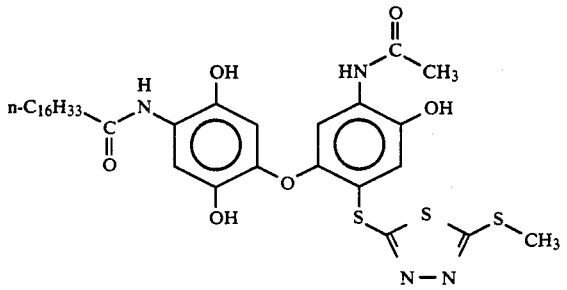
(1a-30)
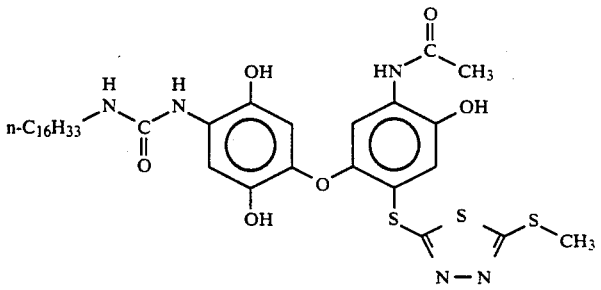
(1a-31)
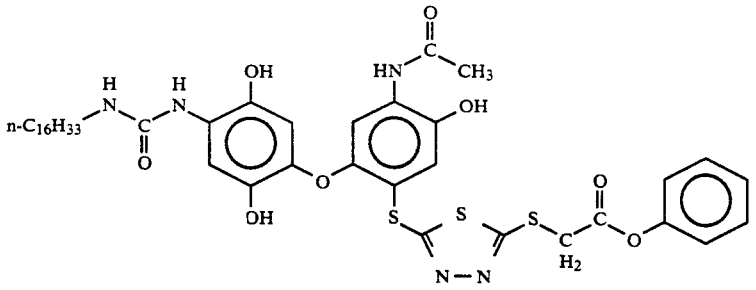
(1a-32)
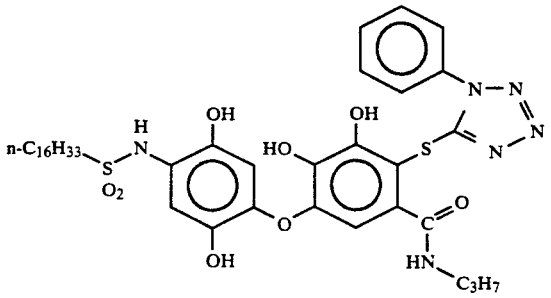

-continued
(1a-33)
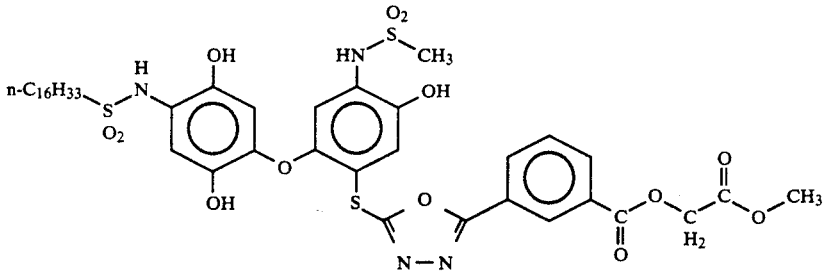
(1a-34)
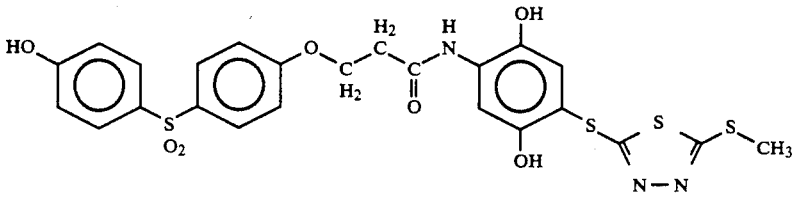
(1a-35)
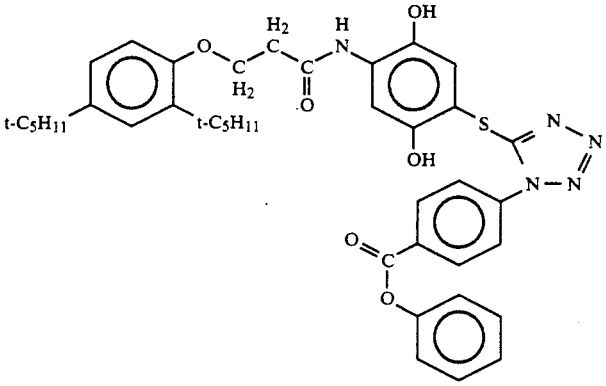
(1b-1)
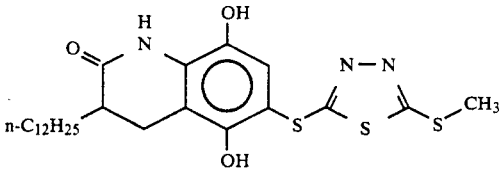
(1b-2)
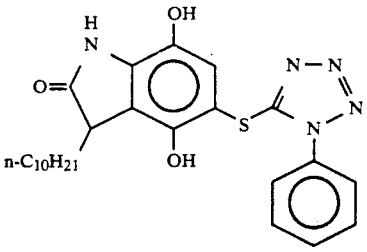
(1b-3)
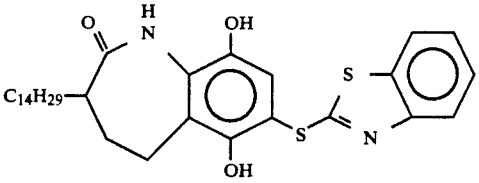
(1b-4)
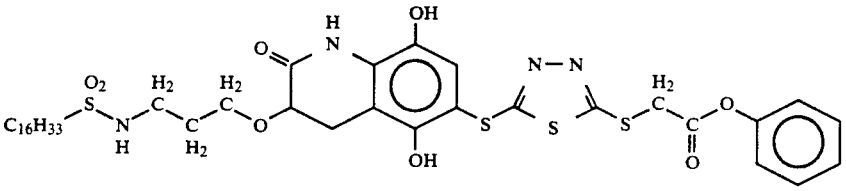

-continued (1b-5)

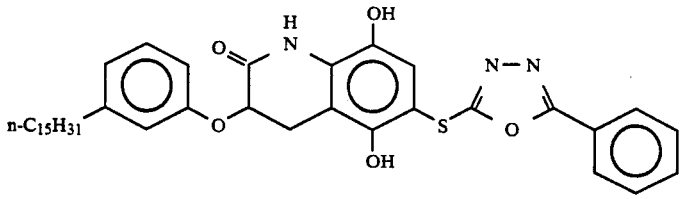

(1b-6)

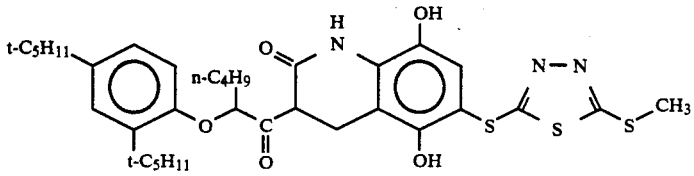

(1b-7)

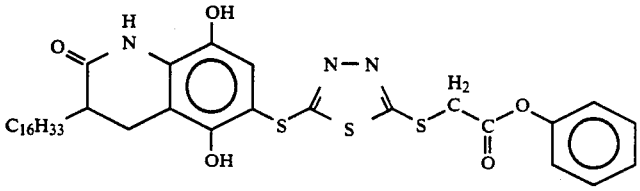

(1b-8)

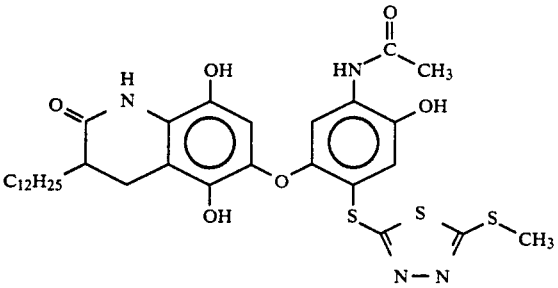

(1b-9)

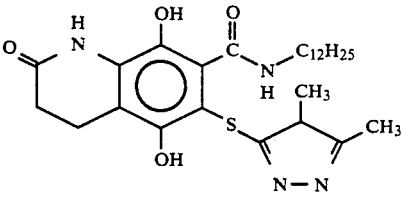

(1b-10)

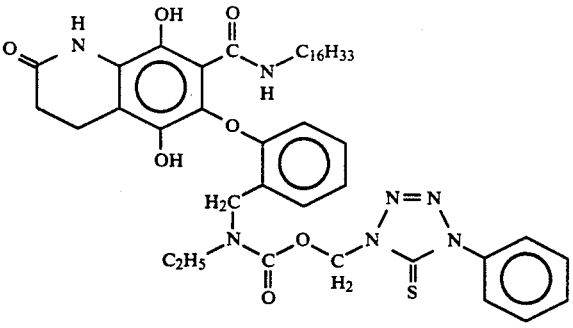

The compound represented by the formula (1a) or (1b) can by synthesize in accordance with methods described in Japanese Patent Provisional Publications No. 49(1974)-129536, No. 52(1977)-57828, No. 60(1985)-21044, No. 60(1985)-233642, No. 60(1985)-233648, No. 61(1986)-18946, No. 61(1986)-156043, No. 61(1986)-213847, No. 61(1986)-230135, No. 61(1986)-236549, No. 62(1987)-62352 and No. (1987)-103639; and U.S. Pat. Nos. 3,379,529, U.S. Pat. No. 3,620,746, U.S. Pat. No. 4,332,828, U.S. Pat. No. 4,377,634 and U.S. Pat. No. 4,684,604.

The compound represented by the formula (1a) or (1b) is contained in the phonographic material preferably in an amount of 0.001 mmole/$m^2$ to 0.2 mmole/$m^2$, and more preferably in an amount of 0.005 mmole/$m^2$ to 0.1 mmole/$m^2$.

The compound represented by the formula (1a) or (1b) may be contained in at least one of the blue, green and red sensitive layers. The compound may also be contained in a non-light-sensitive intermediate layer, which is provided between two of the blue, green and red sensitive layers.

The layer containing the compound represented by the formula (1a) or (1b) preferably is a hydrophilic colloidal layer formed by coating and drying an aqueous mixture of the compound represented by the formula (1a) or (1b) and a polymer which is insoluble in water and soluble in an organic solvent. The polymer more preferably is soluble in ethyl acetate.

The water-insoluble polymer is described below.

It is preferred that the polymer contains a carbonyl bond (—CO—), an ester bond (—COO—) or a carbamoyl group (—CO—$NG_1G_2$, wherein each of $G_1$ and $G_2$ independently is hydrogen, an alkyl group or an aryl group, and the alkyl and aryl groups may have one or more substituent groups). The polymer more preferably contains a carbonyl bond as a repeating unit. The polymer contains the carbonyl bond has a function of accelerating color forming reaction and preventing color discoloration.

On the other hand, the polymer preferably does not contain an acidic group. The acidic group inhibits the function of preventing color discoloration. At least 35 mole % of the repeating units of the polymer preferably (more preferably at least 50 mole %, and most preferably 75 mole %) does not contain an acidic group. The acidic group means an electron attractive group having pKa of not lower than 10. Accordingly, a coupler structure is included in the acidic group.

The polymer preferably contains specific repeating units which forms a homopolymer having a glass transition point (Tg) of not lower than 50 ° C., and more preferably not lower than 80 ° C. The specific repeating unit is particularly effective in acrylamide or methacrylamide polymers.

The polymer preferably is a vinyl polymer or a polyester.

Examples of the monomer which forms the vinyl polymer include acrylates, methacrylates, vinyl esters, acrylamides, methacrylamides, olefins, styrenes and vinyl ethers. Methacrylates, acrylamides and methacrylamides are preferred.

Examples of the acrylates include methyl acrylate, ethyl acrylate, n-propyl acrylate, isopropyl acrylate, n-butyl acrylate, isobutyl acrylate, sec-butyl acrylate, tert-butyl acrylate, amyl acrylate, hexyl acrylate, 2-ethylhexyl acrylate, octyl acrylate, tert-octyl acrylate, 2-chloroethyl acrylate, 2-bromoethyl acrylate, 4-chlorobutyl acrylate, cyanoethyl acrylate, 2-acetoxyethyl acrylate, dimethylaminoethyl acrylate, benzyl acrylate, methoxybenzyl acrylate, 2-chlorocyclohexyl acrylate, cyclohexyl acrylate, furfuryl acrylate, tetrahydrofurfuryl acrylate, phenyl acrylate, 5-hydroxypentyl acrylate, 2,2-dimethyl-3-hydroxypropyl acrylate, 2-methoxyethyl acrylate, 3-methoxybutyl acrylate, 2-ethoxyethyl acrylate, 2-isopropoxy acrylate, 2-butoxyethyl acrylate, 2-(2-methoxyethoxy)ethyl acrylate, 2-(2-butoxyethoxy)ethyl acrylate, ω-methoxypolyethylene glycol acrylate (additional mole, "n"=9), 1-bromo-2-methoxyethyl acrylate and 1,1-dichloro-2-ethoxyethyl acrylate.

Examples of the methacrylates include methyl methacrylate, ethyl methacrylate, n-propyl methacrylate, isopropyl methacrylate, n-butyl methacrylate, isobutyl methacrylate, sec-butyl methacrylate, tert-butyl methacrylate, amyl methacrylate, hexyl methacrylate, cyclohexyl methacrylate, benzyl methacrylate, chlorobenxyl methacrylate, octyl methacrylate, stearyl methacrylate, sulfopropyl methacrylate, N-ethyl-N-phenylaminoethyl methacrylate, 2-(3-phenylpropyloxy)ethyl methacrylate, dimethylaminophenoxyethyl methacrylate, furfuryl methacrylate, tetrahydrofurfuryl methacrylate, phenyl methacrylate, cresyl methacrylate, naphthyl methacrylate, 2-hydroxyethyl methacrylate, 4-hydroxybutyl methacrylate, triethylene glycol monomethacrylate, dipropylene glycol monomethacrylate, 2-methoxyethyl methacrylate, 3-methoxybutyl methacrylate, 2-acetoxyethyl methacrylate, 2-acetoacetoxyethyl methacrylate, 2-ethoxyethyl methacrylate, 2-isopropoxyethyl methacrylate, 2-butoxyethyl methacrylate, 2-(2-methoxyethoxy)ethyl methacrylate, 2-(2-ethoxyethoxy)ethyl methacrylate, 2-(2-butoxyethoxy)ethyl methacrylate, ω-methoxypolyethylene glycol methacrylate (additional mole, "n"=6), allyl methacrylate and chloride salt of dimethylaminoethylmethyl methacrylate.

Examples of the vinyl esters include vinyl acetate, vinyl propionate, vinyl butyrate, vinyl isobutyrate, vinyl caproate, vinyl chloroacetate, vinyl methoxyacetate, vinyl phenyl acetate, vinyl benzoate and vinyl salicylate.

Examples of the acrylamides include acrylamide, N-methylacrylamide, N-ethylacrylamide, N-propylacrylamide, N-butylacrylamide, N-tert-butylacrylamide, N-cyclohexylacrylamide, N-benzylacrylamide, N-hydroxymethylacrylamide, N-methoxyethylacrylamide, N-dimethylaminoethylacrylamide, N-phenylacrylamide, N,N-dimethylcarylamide, N,N-diethylacrylamide, N-β-cyanoethylacrylamide, N-(2-acetoacetoxyethyl)acrylamide and N,N-diacetoneacrylamide.

Examples of the methacrylamides include methacrylamide, N-methylmethacrylamide, N-ethylmethacrylamide, N-propylmethacrylamide, N-butylmethacrylamide, N-tert-butylmethacrylamide, N-cyclohexylmethacrylamide, N-benzylmethacrylamide, N-hydroxymethylmethacrylamide, N-methoxyethylmethacrylamide, N-dimethylaminoethylmethacrylamide, N-phenylmethacrylamide, N,N-dimethylcarylamide, N,N-diethylmethacrylamide, N-β-cyanoethylmethacrylamide and N-(2-acetoacetoxyethyl)methacrylamide.

Examples of the olefins include cyclopentadiene, ethylene, propylene, 1-butene, 1-pentene, vinyl chloride, vinylidene chloride, isoprene, chloroprene, butadiene and 2,3-dimethylbutadiene.

Examples of the styrenes include styrene, methyl styrene, dimethylstyrene, trimethylstyrene, ethylstyrene, isopropylstyrene, chloromethylstyrene, methoxystyrene, acetoxystyrene, chlorostyrene, dichlorostyrene, bromostyrene and methyl vinylbenzoate.

Examples of the vinyl ethers include methyl vinyl ether, butyl vinyl ether, hexyl vinyl ether, methoxyethyl vinyl ether and dimethylaminoethyl vinyl ether.

Examples of the other monomer which forms the vinyl polymer include butyl crotonate, hexyl crotonate, dimethyl itaconate, dibutyl itaconate, diethyl maleate, dimethyl maleate, dibutyl maleate, diethyl fumarate, dimethyl fumarate, dibutyl fumarate, methyl vinyl ketone, phenyl vinyl ketone, methoxyethyl vinyl ketone, glycidyl acrylate, glycidyl methacrylate, N-vinyloxazolidoen, N-vinylpyrrolidone, acrylonitrile, methacrylonitrile, vinylidene chloride, methylenemalononitrile and vinylidene.

Two or more monomers can be used in combination to form a copolymer. A monomer containing an acidic group is available to form a polymer, so long as the formed polymer is water-insoluble.

Examples of the monomer containing an acidic group include acrylic acid, methacrylic acid, itaconic acid, maleic acid, a monoalkyl itaconate (e.g., monomethyl itaconate, monoethyl itaconate, monobutyl itaconate), a monoalkyl maleate (e.g., monomethyl maleate, monoethyl maleate, monobutyl maleate), citraconic acid, styrenesulfonic acid, vinylbenzylsulfonic acid, vinylsulfonic acid, an acryloyloxyalkylsulfonic acid (e.g., acryloyloxymethylsulfonic acid, acryloyloxyethylsulfonic acid, acryloyloxypropylsulfonic acid), a methacryloyloxyalkylsulfonic acid (e.g., methacryloyloxymethylsulfonic acid, methacryloyloxyethyl sulfonic acid, methacryloyloxypropylsulfonic acid), an acrylamidoalkylsulfonic acid (e.g., 2-acrylamido-2-methylethanesulfonic acid, 2-acrylamido-2-methylpropanesulfonic acid, 2-acrylamido-2-methylbutanesulfonic acid) and a methacrylamidoalkylsulfonic acid (e.g., 2-methacrylamido-2-methylethanesulfonic acid, 2-methacrylamido-2-methylpropanesulfonic acide, 2-methacrylamido-2-methylbutanesulfonic acid).

The acidic group may be in the form of an alkali metal (e.g., Na, K) salt or ammonium salt.

Another hydrophilic monomer is also available to form a polymer, so long as the formed polymer is water-insoluble. The hydrophilic monomer is preferably used in an amount of not more than 40 mole %, more preferably not more than 20 mole %, and most preferably not more than 10 mole %.

The polyester may be formed by condensation of a polyhydric alcohol and a polybasic acid.

A preferred polyhydric alcohol is a glycol represented by $HO—R_1—OH$ (wherein $R_1$ is a hydrocarbon chain, preferably an aliphatic chain having 2 to 12 carbon atoms) or a polyalkylene glycol. A preferred polybasic acid is represented by $HOOC—R_2—COOH$ (wherein $R_2$ is a single bond or a hydrocarbon chain having 1 to 12 carbon atoms).

Examples of the polyhydric alcohol include ethylene glycol, diethylene glycol, triethylene glycol, 1,2-propylene glycol, 1,3-propylene glycol, 1,4-butanediol, isobutylenediol, 1,5-pentanediol, neopentyl glycol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,4-diol, glycerin, diglycerin, triglycerin, 1-methylglycerin, erythritol, mannitol and sorbitol.

Examples of the polybasic acid include oxalic acid, succinic acid, glutaric acid, adipic acid, pimelic acid, suberic acid, azelaic acid, sebacic acid, nonanedicarboxylic acid, undecanedicarboxylic acid, dodecanedicarboxylic acid, fumaric acid, maleic acid, itaconic acid, citraconic acid, phthalic acid, isophthalic acid, terephthalic acid, tetrachlorophthalic acid, methaconic acid, isopmelic acid, addact of cyclopentadiene with maleic anhydride and adduct of rosin with maleic anhydride.

The polyester may also be formed by a ring opening polymerization. An example of the ring opening polymerization is represented by the following formula.

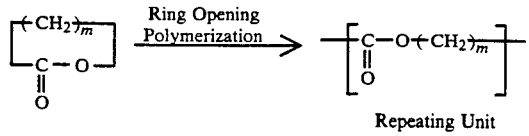

In the formula, m is an integer of 4 to 7. The chain represented by $—CH_2—$ may be branched.

In preparation of this polyester, β-propiolactone, ε-caprolactone or dimethylpropyolactone is preferably used as the monomer.

In preparation of the photographic material, the hydrophilic colloidal layer containing the compound represented by the formula (1a) or (1b) is preferably formed by mixing the compound and the polymer in a solvent and coating and drying the mixture The molecular weight of the polymer should be determined in consideration of the viscosity of the polymer in the solvent to easily prepare the mixture. The viscosity of 30 g of the polymer in 100 cc of the solvent is preferalby not more than 5,000 cps, and more preferably not more than 2,000 cps. The molecular weight of the polymer is preferably not more than 150,000, more preferably not more than 80,000, and most preferably not more than 30,000.

The ratio of the polymer to the solvent should also be determined in consideration of the viscosity of the polymer in the solvent to easily prepare the mixture. The weight ratio of the polymer to the solvent is preferably in the range of 1:1 to 1:50. The weight ratio of the polymer to a coupler is preferably in the range of 1:20 to 20:1, and more preferably in the range of 1:10 to 10:1.

Examples of the polymer are shown below.

| | |
|---|---|
| (P-1) Polyvinyl acetate | (Tg: 32° C.) |
| (P-2) Polyvinyl propionate | (Tg: 20° C.) |
| (P-3) Polymethyl methacrylate | (Tg: 105° C.) |
| (P-4) Polyethyl methacrylate | (Tg: 65° C.) |
| (P-5) Polyethyl acrylate | (Tg: −24° C.) |
| (P-6) Vinyl acetate/vinyl alcohol copolymer (95:5) | (Tg: 32° C.*) |
| (P-7) Poly-n-butyl acrylate | (Tg: −54° C.) |
| (P-8) Poly-n-butyl methacrylate | (Tg: 20° C.) |
| (P-9) Polyisobutyl methacrylate | (Tg: 53° C.) |
| (P-10) Polyisopropyl methacrylate | (Tg: 81° C.) |
| (P-11) Polydecyl methacrylate | (Tg: −70° C.) |
| (P-12) n-Butylacrylate/acrylamido copolymer (95:5) | (Tg: −54° C.) |
| (P-13) Polymethyl chloroacrylate | (Tg: 140° C.) |
| (P-14) Polyester of 1,4-butanediol with adipic acid | (Tg: 68° C.) |
| (P-15) Polyester of ethylene glycol sebacic acid | |
| (P-16) Polycaprolactone | |
| (P-17) Poly(2-tert-butylphenyl acrylate) | (Tg: 72° C.) |
| (P-18) Poly(4-tert-butylphenyl acrylate) | (Tg: 71° C.) |
| (P-19) | (Tg: 20° C.*) |

-continued n-Butyl methacrylate/N-vinyl-2-pyrrolidone copolymer (90:10)
(P-20) (Tg: 105° C.*)
Methyl methacrylate/vinyl chloride copolymer (70:30)
(P-21) (Tg: 105° C.*)
Methyl methacrylate/styrene copolymer
(P-22) (Tg: 105° C.*/−24° C.*)
Methyl methacrylate/ethyl acrylate copolymer (50:50)
(P-23) (Tg: 20° C.*)
n-Butyl methacrylate/methyl methacrylate/styrene copolymer (50:30:20)
(P-24) (Tg: 32° C.*)
Vinyl acetate/acrylamide copolymer (85:15)
(P-25) (Tg: 81° C.*)
Vinyl chloride/vinyl acetate copolymer (65:35)
(P-26) (Tg: 105° C.*)
Methyl methacrylate/acrylonitrile copolymer (65:35)
(P-27) (Tg: 60° C.*/105° C.*)
Diacetoneacrylamide/methyl methacrylate copolymer (50:50)
(P-28) (Tg: —/53° C.*)
Vinyl methyl ketone/isobutyl methacrylate copolymer (55:45)
(P-29) (Tg: 65° C.*)
Ethyl methacrylate/n-butyl acrylate copolymer (70:30)
(P-30) (Tg: 60° C.*/−54° C.*)
Diacetoneacrylamide/n-butyl acrylate copolymer (60:40)
(P-31) (Tg: 105° C.*/104° C.*)
Methyl methacrylate/cyclohexyl methacrylate copolymer (50:50)
(P-32) (Tg: −54° C.*)
n-Butylacrylate/styrene methacrylate/diacetoneacryl amide copolymer (70:20:10)
(P-33) (Tg: 160° C.*/105° C.*)
N-tert-butylmethacrylamide/methyl methacrylate/acrylic acid copolymer (60:30:10)
(P-34) (Tg: 105° C.*)
Methyl methacrylate/styrene/vinylsulfonamide copolymer (70:20:10)
(P-35) (Tg: 105° C.*)
Methyl methacrylate/phenyl vinyl ketone copolymer (70:30)
(P-36) (Tg: −54° C.*/105° C.*)
n-Butyl acrylate/methyl methacrylate/n-butyl methacrylate copolymer (35:35:30)
(P-37) (Tg: 20° C.*/−5° C.*)
n-Butyl methacrylate/pentyl methacrylate/N-vinyl-2-pirrolidone copolymer (38:38:24)
(P-38) (Tg: 105° C.*)
Methyl methacrylate/n-butyl methacrylate/isobutyl methacrylate/acrylic acid copolymer (37:29:25:9)
(P-39) (Tg: 20° C.*)
n-Butyl methacrylate/acrylic acid copolymer (95:5)
(P-40) (Tg: 105° C.*)
Methyl methacrylate/acrylic acid copolymer (95:5)
(P-41) (Tg: 54° C.*)
Benzyl methacrylate/acrylic acid copolymer (90:10)
(P-42) (Tg: 20° C.*/105° C.*)
n-Butyl methacrylate/methyl methacrylate/benzyl methacrylate/acrylic acid copolymer (35:35:25:5)
(P-43) (Tg: 20° C.*)
n-Butyl methacrylate/methyl methacrylate/benzyl methacrylate copolymer (35:35:30)
(P-44) (Tg: −6° C.)
Poly-3-pentyl acrylate
(P-45) (Tg: 104° C.*)
Cyclohexyl methacrylate/methyl methacrylate/n-propyl methacrylate copolymer (37:29:34)
(P-46) (Tg: −5° C.)
Polypentyl methacrylate
(P-47) (Tg: 105° C.*/20° C.*)
Methyl methacrylate/n-butyl methacrylate copolymer (65:35)
(P-48) (Tg: 32° C.*)
Vinyl acetate/vinyl propionate copolymer (75:25)
(P-49) (Tg: 20° C.*)
n-Butyl methacrylate/sodium 3-acryloxybutane-1-sulfonate copolymer (97:3)
(P-50) (Tg: 20° C.*/105° C.*)
n-Butyl methacrylate/methyl methacrylate/acrylamide copolymer (35:35:30)
(P-51) (Tg: 20° C.*/105° C.*)
n-Butyl methacrylate/methyl methacrylate/vinyl chloride copolymer (37:36:27)
(P-52) (Tg: 20° C.*)
n-Butylmethacrylate/styrene copolymer (90:10)
(P-53) (Tg: 105° C.*)
Methyl methacrylate/N-viny-2-pyrrolidone copolymer (90:10)
(P-54) (Tg: 20° C.*)
n-Butyl methacrylate/vinyl chloride copolymer (90:10)
(P-55) (Tg: 20° C.*)
n-Butyl methacrylate/styrene copolymer (70:30)
(P-56) (Tg: 117° C.)
Poly(N-sec-butylacrylamide)
(P-57) (Tg: 128° C.)
Poly(N-tert-butylacrylamide)
(P-58) (Tg: 60° C.*/105° C.*)
Diacetoneacrylamide/methyl methacrylate copolymer (62:38)
(P-59) (Tg: 104° C.*/105° C.*)
Cyclohexyl methacrylate/methyl methacrylate copolymer (60:40)
(P-60) (Tg: 128° C.*/105° C.*)
N-tert-butylacrylamide/methyl methacrylate copolymer (40:60)
(P-61) (Tg: 46° C.)
Poly(N-n-butylacrylamide)
(P-62) (Tg: 118° C.*/128° C.*)
Tert-butyl methacrylate/N-tert-butylacrylamide copolymer (50:50)
(P-63) (Tg: 118° C.*)
Tert-butyl methacrylate/methyl methacrylate copolymer (70:30)
(P-64) (Tg: 160° C.)
Poly(N-tert-butylmethacrylamide)
(P-65) (Tg: 128° C.*/105° C.*)
N-tert-butylacrylamide/methyl methacrylamide copolymer (60:40)
(P-66) (Tg: 105° C.*)
Methyl methacrylate/acrylonitrile copolymer (70:30)
(P-67) (Tg: 105° C.*/—)
Methyl methacrylate/vinyl methyl ketone copolymer (38:62)
(P-68) (Tg: 105° C.*)
Methyl methacrylate/styrene copolymer (75:25)
(P-69) (Tg: 105° C.*)
Methyl methacrylate/hexyl methacrylate copolymer (70:30)
(P-70) (Tg: 6° C.)
Polybenzyl acrylate
(P-71) (Tg: 110° C.)
Poly(4-biphenyl acrylate)

-continued (P-72) (Tg: 13° C.)
Poly(4-butoxycarbonylphenyl acrylate)
(P-73) (Tg: −22° C.)
Poly(sec-butyl acrylate)
(P-74) (Tg: 43° C.)
Poly(tert-butyl acrylate)
(P-75) (Tg: 46° C.)
Poly[3-chloro-2,2-bis(chloromethyl) propyl acrylate]
(P-76) (Tg: 53° C.)
Poly(2-chlorophenyl acrylate)
(P-77) (Tg: 58° C.)
Poly(4-chlorophenyl acrylate)
(P-78) (Tg: 147° C.)
Poly(pentachlorophenyl acrylate)
(P-79) (Tg: 44° C.)
Poly(4-cyanobenzyl acrylate)
(P-80) (Tg: 4° C.)
Poly(cyanoethyl acrylate)
(P-81) (Tg: 90° C.)
Poly(4-cyanophenyl acrylate)
(P-82) (Tg: −24° C.)
Poly(4-cyano-3-thiabutyl acrylate)
(P-83) (Tg: 19° C.)
Poly(cyclohexyl acrylate)
(P-84) (Tg: 30° C.)
Poly(2-ethoxycarbonylphenyl acrylate)
(P-85) (Tg: 24° C.)
Poly(3-ethoxycarbonylphenyl acrylate)
(P-86) (Tg: 37° C.)
Poly(4-ethoxycarbonylphenyl acrylate)
(P-87) (Tg: −50° C.)
Poly(2-ethoxyethyl acrylate)
(P-88) (Tg: −55° C.)
Poly(3-ethoxypropyl acrylate)
(P-89) (Tg: −35° C.)
Poly(1H,1H,5H-octafluoropentyl acrylate)
(P-90) (Tg: −60° C.)
Poly(heptyl acrylate)
(P-91) (Tg: 35° C.)
Poly(hexadecyl acrylate)
(P-92) (Tg: −57° C.)
Poly(hexyl acrylate)
(P-93) (Tg: −24° C.)
Poly(isobutyl acrylate)
(P-94) (Tg: −5° C.)
Poly(isopropyl acrylate)
(P-95) (Tg: −56° C.)
Poly(3-methoxybutyl acrylate)
(P-96) (Tg: 46° C.)
Poly(2-methoxycarbonylphenyl acrylate)
(P-97) (Tg: 38° C.)
Poly(3-methoxycarbonylphenyl acrylate)
(P-98) (Tg: 67° C.)
Poly(4-methoxycarbonylphenyl acrylate)
(P-99) (Tg: −50° C.)
Poly(2-methoxyethyl acrylate)
(P-100) (Tg: 51° C.)
Poly(4-methoxyphenyl acrylate)
(P-101) (Tg: −75° C.)
Poly(3-methoxypropyl acrylate)
(P-102) (Tg: 106° C.)
Poly(3,5-dimethyladamantyl acrylate)
(P-103) (Tg: 47° C.)
Poly(3-dimethylaminophenyl acrylate)
(P-104) (Tg: 86° C.)
Polyvinyl tert-butyrate
(P-105) (Tg: −32° C.)
Poly(2-methylbutyl acrylate)
(P-106) (Tg: −45° C.)
Poly(3-methylbutyl acrylate)
(P-107) (Tg: −15° C.)
Poly(1,3-dimethylbutyl acrylate)
(P-108) (Tg: −38° C.)
Poly(2-methylpentyl acrylate)
(P-109) (Tg: 85° C.)
Poly(2-naphthyl acrylate)
(P-110) (Tg: 57° C.)

-continued

Polyphenyl acrylate
(P-111) (Tg: −37° C.)
Polypropyl acrylate
(P-112) (Tg: 25° C.)
Poly(m-tolyl acrylate)
(P-113) (Tg: 52° C.)
Poly(o-tolyl acrylate)
(P-114) (Tg: 43° C.)
Poly(p-tolyl acrylate)
(P-115) (Tg: 60° C.)
Poly(N,N-dibutylacrylamide)
(P-116) (Tg: 71° C.)
Poly(isohexylacrylamide)
(P-117) (Tg: 66° C.)
Poly(isooctylacrylamide)
(P-118) (Tg: 180° C.)
Poly(N-methyl-N-phenylacrylamide)
(P-119) (Tg: 141° C.)
Polyadamantyl methacrylate
(P-120) (Tg: 54° C.)
Polybenzyl methacrylate
(P-121) (Tg: 52° C.)
Poly(2-bromoethyl methacrylate)
(P-122) (Tg: 33° C.)
Poly(2-N-tert-butylaminoethyl methacrylate)
(P-123) (Tg: 60° C.)
Poly(sec-butyl methacrylate)
(P-124) (Tg: 118° C.)
Poly(tert-butyl methacrylate)
(P-125) (Tg: 92° C.)
Poly(2-chloroethyl methacrylate)
(P-126) (Tg: 91° C.)
Poly(2-cyanoethyl methacrylate)
(P-127) (Tg: 128° C.)
Poly(2-cyanomethylphenyl methacrylate)
(P-128) (Tg: 155° C.)
Poly(4-cyanophenyl methacrylate)
(P-129) (Tg: 104° C.)
Polycyclohexyl methacrylate
(P-130) (Tg: −65° C.)
Polydodecyl methacrylate
(P-131) (Tg: −20° C.)
Polydiethylaminoethyl methacrylate
(P-132) (Tg: 25° C.)
Poly(2-ethylsulfinylethyl methacrylate)
(P-133) (Tg: 15° C.)
Polyhexyadecyl methacrylate
(P-134) (Tg: −5° C.)
Poly(hexyl methacrylate)
(P-135) (Tg: 76° C.)
Poly(2-hydroxypropyl methacrylate)
(P-136) (Tg: 106° C.)
Poly(4-methoxycarbonylphenyl methacrylate)
(P-137) (Tg: 196° C.)
Poly(3,5-dimethyladamantyl methacrylate)
(P-138) (Tg: 20° C.)
Polydimethylaminoethyl methacrylate
(P-139) (Tg: 45° C.)
Poly(3,3-dimethylbutyl methacrylate)
(P-140) (Tg: 108° C.)
Poly(3,3-dimethyl 2-butyl methacrylate)
(P-141) (Tg: 1° C.)
Poly(3,5,5-trimethylhexyl methacrylate)
(P-142) (Tg: −100° C.)
Polyoctadecyl methacrylate
(P-143) (Tg: 80° C.)
Polytetradecyl methacrylate
(P-144) (Tg: 128° C.)
Poly(4-butoxycarbonylphenylmethacrylamide)
(P-145) (Tg: 200° C.)
Poly(4-carboxyphenylmethacrylamide)
(P-146) (Tg: 168° C.)
Poly(4-ethoxycarbonylphenylmethacrylamide)
(P-147) (Tg: 180° C.)
Poly(4-methoxycarbonylphenylmeth- -continued

| | |
|---|---|
| acrylamide) | |
| (P-148) | (Tg: 25° C.) |
| Poly(butyl butoxycarbonylmethacrylate) | |
| (P-149) | (Tg: 57° C.) |
| Poly(butyl chloroacrylate) | |
| (P-150) | (Tg: 85° C.) |
| Poly(butyl cyanoacrylate) | |
| (P-151) | (Tg: 114° C.) |
| Poly(cyclohexyl chloroacrylate) | |
| (P-152) | (Tg: 93° C.) |
| Poly(ethyl chloroacrylate) | |
| (P-153) | (Tg: 52° C.) |
| Poly(ethyl ethoxycarbonylmethacrylate) | |
| (P-154) | (Tg: 27° C.) |
| Poly(ethyl ethacrylate) | |
| (P-155) | (Tg: 43° C.) |
| Poly(ethyl fluoromethacrylate) | |
| (P-156) | (Tg: −4° C.) |
| Poly(hexylhexyl oxycarbonylmethacrylate) | |
| (P-157) | (Tg: 90° C.) |
| Poly(isobutyl chloromethacrylate) | |
| (P-158) | (Tg: 90° C.) |
| Poly(isopropyl chloroacrylate) | |

The Tg shown above is the glass transition point. The mark(*) shown above indicates the glass transition point of the homopolymer formed by the monomer which is contained in at least 35 mole % of the polymer and which does not contain an acidic group.

The structure of the photographic material of the present invention, particularly the order of the layers is described below.

In the photographic material of the present invention, at least one layer of silver halide emulsion layers of a blue sensitive layer, a green sensitive layer and a red sensitive layer is provided. There is no specific limitation on the number of the silver halide emulsion layers and the non-light-sensitive layers and the order of those layers. A typical example is a silver halide photographic material comprising a support and at least one light-sensitive layer provided thereon which comprises plural silver halide emulsion layers having substantially the same spectral sensitivities and having different strengths of the sensitivity. In this photographic material, the light-sensitive layer is a unit light-sensitive layer having color sensitivity for any of blue light, green light and red light. In a multi-layer silver halide color photographic material, the unit light-sensitive layers are generally arranged in such a manner that the red sensitive layer, the green sensitive layer and the blue sensitive layer are provided in this order from the support side. However, the reverse order of the above arrangement may be possible, or other arrangement in which a different light-sensitive layer is sandwiched between the same sensitive layers may be possible, depending on the purpose. Non-light-sensitive layers such as various intermediate layers can be provided between the above-mentioned silver halide light-sensitive layers, or as the top layer or the bottom layer.

The intermediate layer may contain couplers and DIR compounds as described in Japanese Patent Provisional Publications No. 61(1986)-43748, No. 59(1974)-113438, No. (1974)-113440, No. 61(1986)-20037 and No. 61(1986)-20038, or may contain color stain inhibitors which are conventionally employed.

As the plural silver halide emulsion layers constituting each unit light-sensitive layer, a two-layer structure consisting of a high sensitive emulsion layer and a low sensitive emulsion layer can be preferably used as described in West German Patent No. 1,121,470 and U.K. patent No. 923,045. In general, those layers are preferably arranged in such a manner that the sensitivities of the layers become lower in order towards the support. Between each silver halide emulsion layers may be provided the non-light-sensitive layer. Further, it is possible to arrange a low sensitive emulsion layer on the side far from the support and a high sensitive emulsion layer on the side near the support, as described in Japanese Patent Provisional Publications No. 57(1982)-112751, No. 62(1987)-200350, No. 62(1987)-206541 and No. 62(1987)-206543.

As a concrete example, a low blue sensitive layer (BL), a high blue sensitive layer (BH), a high green sensitive layer (GH), a low green sensitive layer (GL), a high red sensitive layer (RH) and a low red sensitive layer (RL) can be arranged in this order from the farthest side of the support. Otherwise, an arrangement of BH, BL, GL, GH, RH and RL in this order from the farthest side of the support, or an arrangement of BH, BL, GH, GL, RL and RH in this order from the farthest side of the support is possible.

Further, a blue sensitive layer, GH, RH, GL and RL may be arranged in this order from the farthest side of the support as described in Japanese Patent Publication No. 55(1980)-34932, or a blue sensitive layer, GL, RL, GH and RH may be arranged in this order from the farthest side of the support as described in Japanese Patent Provisional Publications No. 56(1981)-25738 and No. 62(1987)-63936.

Moreover, as described in Japanese Patent Publication No. 49(1974)-15495, there can be arranged a silver halide emulsion layer having a high sensitivity as the top layer, a silver halide emulsion layer having a middle sensitivity as a central layer and a silver halide emulsion layer having a low sensitivity as the bottom layer, that is, there can be exemplified an arrangement of three layers having different strengths of the sensitivity in which the sensitivities of the layers are lowered in order towards the support. Even in the case of the structure composed of three layers having different sensitivities, the layers having the same spectral sensitivity may be arranged in the order of a middle sensitive emulsion layer, a high sensitive emulsion layer and a low sensitive emulsion layer.

As described above, any layer-structure or any layer-arrangement can be selected depending on the purpose of the photosensitive material.

Next, the silver halide emulsion layer is described below.

In the photographic material of the invention, preferred silver halide contained in the emulsion layer is silver iodobromide, silver iodochloride or silver chloroiodobromide, containing silver iodide in an amount of not more than about 30% by mole. Particularly preferred is silver iodobromide or silver chloroiodobromide, containing silver iodide in an amount of about 0.1 to 50% by mole.

The shape of the silver halide grain in the photographic emulsion may be either in the form of a regular crystal such as cube, octahedron and tetradecahedron, or in the form of an irregular crystal such as globular shape and plate shape, or in the form of a crystal having crystal defect such as twinning plane. Further, the shape of the grain may be complex of these crystals.

The silver halide grains may be either fine grains whose size is not more than about 0.2 μm or large grains whose projected area is about 10 μm in diameter. The emulsion containing the silver halide grains may be either a polydispersed emulsion or a mono-dispersed emulsion.

A photographic emulsion of silver halide available for the invention can be prepared in accordance with a known method described in, for example, "Emulsion Preparation and Types", *Research Disclosure*, No. 17643 (December, 1978), pp. 22–23; or ibid., No. 18716 (November, 1979), pp. 648; "Chimie et Physique Photographique" by P. Glafkides, Paul Montel, 1967; "Photographic Emulsion Chemistry" by G. F. Duffin, Focal Press, 1966; or "Making and Coating Photographic Emulsion" by V. L. Zelikman et al., Focal Press, 1964.

A monodispersed emulsion described in U.S. Pat. Nos. 3,574,628 and U.S. Pat. No. 3,655,394, U.K. Patent 1,413,748 is also preferable.

A tabular silver halide grain having an aspect ratio of not less than 5 can be also employed in the invention. A tabular silver halide grain can be easily prepared in accordance with methods described in "Photographic Science and Engineering" by Gutoff, vol. 14(1970), pp. 248–257; U.S. Pat. Nos. 4,434,226, U.S. Pat. No. 4,414,310, U.S. Pat. No. 4,433,048 and U.S. Pat. No. 4,439,520; and U.K. Patent No. 2,112,157.

The crystal may have either a homogeneous structure, a heterogeneous structure in which halogens located at the inside and the outside are different from each other, or a structure consisting of layers. Some silver halides in which halogens are different from each other may connect by epitaxial bond to form the crystal, or a salt other than silver halide such as silver rhodanite and lead oxide also may connect to the silver halide crystal by epitaxial bond.

A mixture of grains of various crystals is also available.

Generally, a silver halide emulsion having been subjected to physical ripening, chemical ripening and spectral sensitization is used in the invention. Additives used in these processes are described in *Research Disclosure* No. 176432 and ibid., No. 18716. The pages in which the additives are described are set forth in the following table. Known photographic additives available for the invention are also described in the above two Research Disclosures. The pages are also set forth in the following table.

TABLE

| Additives | R.D. No. 17643 | R.D. No. 18716 |
|---|---|---|
| 1. Chemical Sensitizer | p. 23 | p. 648, Right |
| 2. Sensitivity Promoter | | same as above |
| 3. Spectral Sensitizer Color Sensitizer | pp. 23–24 | pp. 648, Right–649, Left |
| 4. Whitening Agent | p. 24 | |
| 5. Antifoggant and Stabilizer | pp. 24–25 | p. 649, Right |
| 6. Light Absorber, Filter Dye, U.V. Absorber | pp. 25–26 | pp. 649, Right–650, Left |
| 7. Antistain Agent | p. 25, Right | p. 650, Left–Right |
| 8. Dye Image Stabilizer | p. 25 | |
| 9. Hardening Agent | p. 26 | p. 651, Left |
| 10. Binder | p. 26 | same as above |
| 11. Plasticizer, Lubricant | p. 27 | p. 650, Right |
| 12. Coating Aid, Surface Active Agent | pp. 26–27 | p. 650, Right |
| 13. Antistatic Agent | p. 27 | same as above |

In order to prevent deterioration of photographic properties caused by formaldehyde gas, compounds which react with formaldehyde to fix it, described in U.S. Pat. Nos. 4,411,987 and U.S. Pat. No. 4,435,503, are preferably added to the photographic material.

Various color couplers can be used for the invention. Concrete examples of the couplers are described in the patents cited in the aforementioned *Research Disclosure* No. 17643, VII C–G.

As yellow couplers, preferred are those described in, for example, U.S. Pat. Nos. 3,933,501, U.S. Pat. No. 4,022,620, U.S. Pat. No. 4,326,024, U.S. Pat. No. 4,401,752 and U.S. Pat. No. 4,248,961, Japanese Patent Publication No. 58(1983)-10739, U.K. Patents No. 1,425,020 and No. 1,476,760, U.S. Pat. Nos. 3,973,968, U.S. Pat. No. 4,314,023 and U.S. Pat. No. 4,511,649, and European Patent No. 249,473A. As magenta couplers, 5-pyrazolone type and pyrazoloazole type compounds are preferred, and particularly preferred are those described in U.S. Pat. Nos. 4,310,619 and U.S. Pat. No. 4,351,897, European Patent No. 73,636, U.S. Pat. Nos. 3,061,432 and U.S. Pat. No. 3,725,067, *Research Disclosure* No. 24220 (June, 1984), Japanese Patent Provisional Publication No. 60(1985)-33552, *Research Disclosure* No. 24230 (June, 1984), Japanese Patent Provisional Publications No. (1985)-43659, No. 61(1986)-72233, No. 60(1985)-35730, No. (1980)-118034 and No. 60(1985)-185951, U.S. Pat. Nos. 4,500,630, U.S. Pat. No. 4,540,654 and U.S. Pat. No. 4,556,630, and International Publication No. W088/04795.

As cyan couplers, there can be mentioned phenol type and naphthol type couplers, and preferred examples are those described in U.S. Pat. Nos. 4,052,212, U.S. Pat. No. 4,146,396, U.S. Pat. No. 4,228,233, U.S. Pat. No. 4,296,200, U.S. Pat. No. 2,369,929, U.S. Pat. No. 2,801,171, U.S. Pat. No. 2,772,162, U.S. Pat. No. 2,895,826, U.S. Pat. No. 3,772,002, U.S. Pat. No. 3,758,308, U.S. Pat. No. 4,334,011 and U.S. Pat. No. 4,327,173, West German Patent Publication No. 3,329,729, European Patents No. 121,365A and No. 249,453A, U.S. Pat. Nos. 3,446,622, U.S. Pat. No. 4,333,999, U.S. Pat. No. 4,775,616, U.S. Pat. No. 4,451,559, U.S. Pat. No. 4,427,767, U.S. Pat. No. 4,690,889, U.S. Pat. No. 4,254,212 and U.S. Pat. No. 4,296,199, and Japanese Patent Provisional Publication No. 61(1986)-42658.

Colored couplers to compensate incidental absorption of a formed dye are preferably those described in *Research Disclosure* No. 17643, VII–G, U.S. Pat. No. 4,163,670, Japanese Patent Publication No. 57(1982)-39413, U.S. Pat. Nos. 4,004,929 and U.S. Pat. No. 4,138,258, and U.K. Patent No. 1,146,368. It is also preferred to use a coupler whose fluorescent dye released in coupling stage compensates incidental absorption of a formed dye as described in U.S. Pat. No. 4,774,181, and a coupler having as an eliminating group a dye precursor which reacts with a developing agent to form a dye as described in U.S. Pat. No. 4,777,120.

As a coupler which gives a color developing dye exhibiting a proper diffusion, preferred are those described in U.S. Pat. No. 4,366,237. U.K. Patent No. 2,125,570, European Patent No. 96,570, and West German Patent Publication No. 3,234,533.

Typical examples of polymerized dye-forming couplers are described in U.S. Pat. Nos. 3,451,820, U.S. Pat. No. 4,080,211, U.S. Pat. No. 4,367,282, U.S. Pat. No. 4,409,320 and U.S. Pat. No. 4,576,910, and U.K. Patent No. 2,102,173.

A coupler which releases a photographically useful residue in accordance with coupling can be also used in the invention. DIR couplers which release a development inhibitor are preferably those described in the patents cited in the aforementioned *Research Disclosure* No. 17643, VII-F, Japanese Patent Provisional Publications No. 57(1982)-151944, No. 57(1982)-154234, No. 60(1985)-184248 and No. 63(1988)-37346, and U.S. Pat. Nos. 4,248,962 and No. 4,782,012.

Couplers which imagewise release a nucleating agent or a development accelerator in the developing process are preferably those described in U.K. Patents No. 2,097,140 and No. 2,131,188, and Japanese Patent Provisional Publications No. 59(1984)-157638 and No. 59(1984)-170840.

Examples of other couplers available for the photosensitive material of the invention include a competing coupler described in U.S. Pat. No. 4,130,427; a polyvalent coupler described in U.S. Pat. Nos. 4,283,472, U.S. Pat. No. 4,338,393 and U.S. Pat. No. 4,310,618; a DIR redox compound releasing coupler, a DIR coupler-releasing coupler, a DIR coupler-releasing redox compound or a DIR redox-releasing redox compound described in Japanese Patent Provisional Publications No. 60(1985)-185950 and No. 62(1987)-24252; a coupler which releases a dye having restoration to original color after elimination described in European Patent No. 173,302A; a bleach accelerator-releasing coupler described in *Research Disclosure* No. 11449, ibid. No. 24241, and Japanese Patent Provisional Publication No. 61(1986)-201247; a coupler which releases ligand described in U.S. Pat. No. 4,553,477; a coupler which releases a leuco dye described in Japanese Patent Provisional Publication No. 63(1988)-75747; and a coupler which releases a fluorescent dye described in U.S. Pat. No. 4,774,181.

The couplers used in the invention can be introduced into the photographic material by various known dispersing methods.

Examples of high-boiling solvents employable in an O/W dispersing method are described in U.S. Pat. No. 2,322,027.

Concrete examples of the high-boiling organic solvents having a boiling point of not lower than 175° C. under a normal pressure employable in the O/W dispersing method include phthalic esters (e.g., dibutyl phthalate, dicyclohexyl phthalate, di-2-ethylhexyl phthalate, decyl phthalate, bis(2,4-di-t-amylphenyl)phthalate, bis(2,4-di-t-amylphenyl)isophthalate, bis(1,1-diethylpropyl)phthalate); esters of phosphoric acids or phosphonic acids (e.g., triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, di-2-ethylhexylphenyl phosphate); benzoic esters (e.g., 2-ethylhexyl benzoate, dodecyl benzoate, 2-ethylehecyl p-hydroxybenzoate); amides (e.g., N,N-diethyldodecanamide, N,N-diethyllaurylamide, N-tetradecylpyrrolidone); alcohols or phenols (e.g., isostearyl alcohol, 2,4-di-tert-amylphenol); aliphatic car boxylic esters (e.g., bis(2-ethylhexyl)sebacate, dioctyl azelate, glycerol tributylate, isostearyl lactate, trioctyl citrate); aniline derivatives (e.g., N,N-dibutyl-2-butoxyl-5-ter-octylaniline); and hydrocarbons (e.g., paraffin, dodecyl benzene, diisopropyl naphthalene). As an assisting solvent, there can be used organic solvents having a boiling point of not lower than about 30° C., preferably in the range of 50° C. to about 160° C., and typical examples thereof include ethyl acetate, butyl acetate, ethyl propionate, methyl ethyl ketone, cyclohexanone, 2-ethoxyethyl acetate and dimethylformamide.

A high-boiling organic solvent having a dielectric constant of not less than 6.0 is particularly preferred. Examples of the solvent are represented by the following formulas.

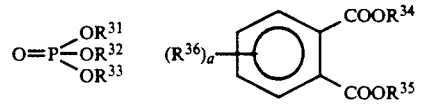

In the formulas, each of $R^{31}$, $R^{32}$, $R^{33}$, $R^{34}$ and $R^{35}$ independently is an alkyl group or a cycloalkyl group. $R^{36}$ is a halogen atom (F, Cl, Br or I), an alkyl group, an alkoxy group, an aryloxy group or an alkoxycarbonyl group. In the formulas, "a" is an integer of 0 or 1 to 3. When "a" is 2 or 3, the groups represented by $R^{36}$ may be different from each other.

A process of a latex dispersing method, effects thereof and concrete examples of latex for impregnation are described in U.S. Pat. No. 4,199,363, West German Patent Applications (OLS) No. 2,541,274 and No. 2,541,230.

Further, these couplers can be emulsified and dispersed in an aqueous solution of hydrophilic colloid by impregnating a rhodable latex polymer (e.g., U.S. Pat. No. 4,203,716) with these couplers in the presence or absence of the aforementioned high-boiling organic solvent or by dissolving these couplers in a water-insoluble and organic solvent-soluble polymer.

Preferably, homopolymers and copolymers described in International Publication No. W088/00723, pp. 12–30, are employed. Particularly, it is preferred to use acrylamide type polymers from the viewpoint of stabilization of a color image.

The color photographic material of the invention preferably contains various antiseptic or antimold agents such as benzoisothiazolone, n-butyl-p-hydroxybenzoate, phenol and 2-(4-thiazolyl)benzimidazole described in Japanese Patent Provisional Publications No. 63(1988)-257747 and No. 62(1987)-272248, and Japanese Patent Application No. 62(1987)-238096.

The photographic material of the invention may contain a dye represented by the following formula.

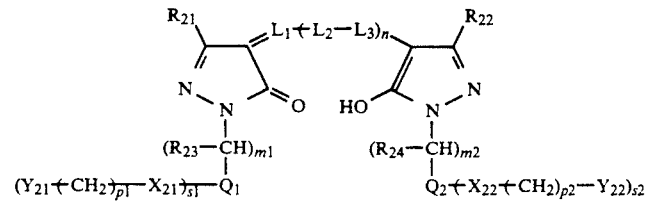

In the formula, each of $R_{21}$ and $R_{22}$ independently is $COOR_{25}$ or $COOR_{25}R_{26}$. Each of $R_{25}$ and $R_{26}$ independently is hydrogen, an alkyl group or an aryl group. $R_{25}$ and $R_{26}$ may form a 5-membered or 6-membered ring. Each of $Q_1$ and $Q_2$ independently is an aryl group. Each of $X_{21}$ or $X_{22}$ independently is a single bond or a divalent linking group. Each and $Y_{21}$ and $Y_{22}$ independently is sulfo or carboxyl. Each of $L_1$, $L_2$ and $L_3$ independently is a methyne group. In the formula, each of m1 and m2 independently is 1 or 2, n is 0, 1 or 2, each of p1 and p2 independently is 0, 1, 2, 3 or 4 , and each of s1 and s2 independently is 1 or 2. The photographic material of the invention may further contains a water-insoluble epoxy compound represented by the following formula.

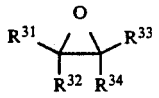

In the formula, each of $R^{31}$, $R^{32}$, $R^{33}$ and $R^{34}$ independently is hydrogen, an aliphatic group, an aromatic group, an aliphaticoxycarbonyl group, an aromatic oxycarbonyl group or a carbamoyl group. At least one of $R^{31}$, $R^{32}$, $R^{33}$ and $R^{34}$ is not hydrogen. The number of the total carbon atoms contained in $R^{31}$, $R^{32}$, $R^{33}$ and $R^{34}$ is 8 to 60. $R^{31}$ and $R^{32}$ may form a 5 to 7-membered ring. $R^{33}$ and $R^{34}$ also may form a 5 to 7-membered ring.

The present invention can be applied to various color photographic materials. Representative examples thereof include color negative films for domestic use or motion pictures, color reversal films for slide and television, color paper, color positive films, and color reversal paper.

Appropriate supports employable in the invention are described in, for example, the aforementioned *Research Disclosure* No. 17643, p. 28, and ibid., No. 18716, pp. 647 (right)–648 (left). In the photographic material of the invention, the total film thickness of all of the hydrophilic colloidal layers on the side having the emulsion layer is preferably not more than 28 μm, more preferably not more than 23 μm, most preferably not more than 20 μm. Further, the film swelling speed $T_{\frac{1}{2}}$ is preferably not more than 30 sec. The terms "film thickness" means a film thickness measured at 25° C. and a relative humidity of 55% under moisture conditioning (2 days), and the film swelling speed $T_{\frac{1}{2}}$ can be measured according to a manner known in the technical art. The film swelling speed can be measured using, for example, a swellometer described in Photographic Science and Engineering, vol. 19, No. 2, pp. 124–129, by A. Green et al. $T_{\frac{1}{2}}$ is defined as a time required to reach a saturated film thickness of a film, in the case where the saturated film thickness is 90% of a maximum swelling film thickness given when the film is treated with a color developer at 30° C. for 3 minutes and 15 seconds.

The film swelling speed $T_{\frac{1}{2}}$ can be adjusted by adding a hardening agent to gelatin used as a binder or varying conditions on the elapsed time after a coating process. Further, the swelling degree is preferably between 150 and 400%. The swelling degree can be calculated using the maximum swelling film thickness under the conditions described above in accordance with the formula: (Maximum swelling film thickness film thickness) / film thickness.

The color photographic material according to the invention can be developed by conventional processes described in the aforementioned *Research Disclosure* No. 17643, pp. 28–29, and ibid., No. 18716, p. 615 (left to right).

The present invention shows marked effects when it is treated with a developer containing a solvent for silver halide, for example, sulfurous acid soda, potassium thiocyanate and thioethers. A concrete example of the developers is a first developer used in the reversal processing.

The amount of the solvent for the silver halide is preferably not less than 0.1 g, more preferably not less than 0.5 g, per 1 l of the developer. The upper limit of the amount thereof is a saturated dissolving amount. The solvent is preferably employed in combination of two or more kinds.

The effect of the present invention is markedly shown when rapidity is required for the process of treating the invention, and it is desired that the process is carried out under such conditions that the temperature is high (not lower than 33° C.), the processing time is short and the time for the first developing is not longer than 6 minutes. Particularly, the effect of the invention is markedly shown when the first developing is carried out at a temperature of not lower than 38° C. and for a period of time of not longer than 90 seconds, preferably not longer than 60 seconds.

The color reversal film treating process generally comprises the basic steps of:

Black and white development (first development) → stopping → washing → reversing → washing → color development → stopping → washing → compensating bath → washing → bleaching → washing → fixing → washing → stabilizing → drying.

To this process may be further added prebath, prehardening bath or nuetralizing bath. Otherwise, each washing process conducted after stopping, reversing, color developing, compensating bath or bleaching may be omitted. The reversing bath may be replaced with re-exposure, or may be omitted if a fogging agent is added to the color developing bath.

As black and white developers, any known developing agents such as dihydroxybenzenes (e.g., hydroquinone), 3-pyrazolidones (e.g., 1-phenyl-3-pyrazolidone), aminophenols (e.g., N-methyl-p-aminophenol) can be employed singly or in combination.

The black and white developing solution may contain development inhibitors such as carbonate, borate, phosphate, sulfite, bromide and iodide, or antifogging agents such as organic antifogging agent, in addition to the aforementioned solvent for silver halide. If necessary, the developer may further contain softening agents, preservatives (e.g., hydroxylamine), organic solvents (e.g., benzyl alcohol and diethylene glycol), development accelerators (e.g, polyethylene glycol, quaternary ammonium salt and amines), dye forming couplers, competing couplers, fogging agents (e.g., sodium boronhydride), developing aids (e.g., 1-phenyl 3-pyrazolidone), viscosity-imparting agents, polycarboxylic acid type chelating agents described in U.S. Pat. No. 4,083,723, and antioxidants described in West German Patent Publication (OLS) No. 2,622,950.

The pH value of the black and white developing solution is preferably adjusted to 8.5 to 11.5. The black and white development is carried out preferably for not more than 75 seconds, and more preferably for not more than 60 seconds.

A color developer is generally made of an alkaline aqueous solution containing a color developing agent. As the color developing agent, there can be employed any known primary aromatic amine developing agents such as phenylene. diamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamideethylaniline, 4-amino-3-methyl-N-ethyl-N-β-methoxyethylanilie).

Other than the above-mentioned developing agents, also employable are those described in F. A. Mason, "Photographic Processing Chemistry", Focal Press, pp. 226–229 (1966), U.S. Pat. Nos. 2,193,015 and U.S. Pat. No. 2,592,364, and Japanese patent Provisional Publication No. 48(1973)-64933.

Further, the color developer can also contain additives described with respect to the black and white developer.

The bleaching process may be conducted simultaneously with the fixing process. Otherwise, those processes may be conducted separately. Examples of the bleaching agents employable in the bleaching process include polyvalent metal compounds such as iron(III), cobalt(III), chromium(VI) and copper(II), peroxides, quinones and nitroso compounds. Concretely, there can be employed organic complex salts of ferricyanides, dichromates, iron(III) or cobalt(III), for example, complex salts of organic acids such as aminopoly. carboxylic acid (e.g., ethylenediaminetetraacetaic acid, nitrilotriacetic acid, 1,3-diamino-2-propanoltetraacetic acid), citric acid, tartaric acid and malic acid; persulfates; permanganates; and nitroso phenols. Of these, particularly useful are potassium ferricyanide, ethylenediaminetetraacetic acid sodium iron(III) salt and and ethyolenediaminetetraacetic acid ammonium iron (III) salt. Ethylenediaminetetraacetic acid iron (III) salt is useful both in the individual bleaching bath and the combined bleach-fix bath.

To the bleaching bath or the bleach-fix bath may be also added bleaching accelerators described in U.S. Pat. Nos. 3,042,520 and U.S. Pat. No. 3,241,966, and Japanese Patent Publications No. 45(1970)-8506 and No. 45(1970)-8836, thiol compounds described in Japanese Patent Provisional Publication No. 53(1978)-65732, and other various additives.

The present invention is further described by the following examples, but those examples are given by no means to restrict the invention.

EXAMPLE 1

A paper was laminated with polyethylene on the both sides to prepare a paper support (thickness: 100 μm). On the surface of the paper support, the following first to twelfth layers are provided to prepare a color photographic photosensitive material. The obtained photographic material (sample) was numbered as No. 101. Polyethylene laminated on the first layer side included anatase-type titanium oxide as a white pigment and an extremely small amount of ultramarine as a blue dye.

COMPOSITION OF LAYERS

The composition and its amount (g/m$^2$) of each layer are set forth below. The values for the silver halide emulsions mean the coating amount of silver. The total silver content of the sample No. 101 was 1.1 g/m$^2$.

| | |
|---|---|
| The first layer (Gelatin layer) | |
| Gelatin | 1.30 |
| The second layer (Antihalation layer) | |
| Black colloidal silver | 0.10 |
| Gelatin | 0.70 |
| The third layer (Low red sensitive layer) | |
| Silver chloroiodobromide spectrally sensitized with red sensitizing dye (mixture of ExS-1, 2, 3 in the ratio of 1:1:1) [silver chloride: 1 mole %; silver iodide: 4 mole %; mean grain size: 0.3 μm; size distribution: 10%; cubic; iodine core-type core shell] | 0.06 |
| Silver iodobromide spectrally sensitized with red sensitizing dye (mixture of ExS-1, 2, 3 in the ratio of 1:1:1) [silver iodide: 4 mole %; mean grain size: 0.5 μm; size distribution: 15%; cubic] | 0.07 |
| Gelatin | 1.00 |
| Cyan coupler (ExC-1) | 0.14 |
| Cyan coupler (ExC-2) | 0.07 |
| Discoloration inhibitor (mixture of Cpd-2, 3, 4 in the ratio of 1:1:1) | 0.12 |
| Coupler dispersion medium (Cpd-6) | 0.03 |
| Coupler solvent (mixture of Solv-1, 2, 3 in the ratio of 1:1:1) | 0.06 |
| Development accelerator (Cpd-13) | 0.05 |
| The fourth layer (High red sensitive layer) | |
| Silver iodobromide spectrally sensitized with red sensitizing dye (mixture of ExS-1, 2, 3 in the ratio of 1:1:1) [silver iodide: 6 mole %; mean grain size: 0.8 μm; size distribution: 20%; tabular (aspect ratio = 8, iodine core type] | 0.15 |
| Gelatin | 1.00 |
| Cyan coupler (ExC-1) | 0.20 |
| Cyan coupler (ExC-2) | 0.10 |
| Discoloration inhibitor (mixture of Cpd-2, 3, 4 in the ratio of 1:1:1) | 0.15 |
| Coupler dispersion medium (Cpd-6) | 0.03 |
| Coupler solvent (mixture of Solv-1, 2, 3 in the ratio of 1:1:1) | 0.10 |
| The fifth layer (Intermediate layer) | |
| Magenta colloidal silver | 0.05 |
| Gelatin | 1.00 |
| Color stain inhibitor (mixture of Cpd-7, 16 in the ratio of 1:1) | 0.08 |
| Color stain inhibitor solvent (mixture of Solv-4, 5 in the ratio of 1:1) | 0.16 |
| Polymer latex (Cpd-8) | 0.10 |
| The sixth layer (Low green sensitive layer) | |
| Silver chloroiodobromide spectrally sensitized with green sensitizing dye (ExS-4) [silver chloride: 1 mole %; silver iodide: 2.5 mole %; mean grain size: 0.28 μm; size distribution: 8%; cubic, iodine core-type core shell] | 0.03 |
| Silver iodobromide spectrally sensitized with green sensitizing dye (ExS-4) [silver iodide: 2.5 mole %; mean grain size: 0.48 μm; size distribution: 12%; cubic] | 0.05 |
| Gelatin | 0.80 |
| Magenta coupler (mixture of ExM-1, 2 in the ratio of 1:1) | 0.10 |
| Discoloration inhibitor (Cpd-9) | 0.10 |
| Stain inhibitor (mixture of Cpd-10, 11 in the ratio of 1:1) | 0.01 |
| Stain inhibitor (Cpd-5) | 0.001 |
| Stain inhibitor (Cpd-12) | 0.01 |
| Coupler dispersion medium (Cpd-5) | 0.05 |
| Coupler solvent (mixture of Solv-4, 6 in the ratio of 1:1) | 0.15 |
| The seventh layer (High green sensitive layer) | |
| Silver iodobromide spectrally sensitized with green sensitizing dye (ExS-4) [silver iodide: 3.5 mole %; mean grain size: 1.0 μm; size distribution: 21%; tabular (aspect ratio = 9, iodine homogeneously- dispersed type] | 0.10 |
| Gelatin | 0.80 |
| Magenta coupler (mixture of ExM-1, 2 in the ratio of 1:1) | 0.10 |
| Discoloration inhibitor (Cpd-9) | 0.10 |
| Stain inhibitor (mixture of Cpd-10, 11, 22, in the ratio of 1:1:1) | 0.01 |
| Stain inhibitor (Cpd-5) | 0.001 |
| Stain inhibitor (Cpd-12) | 0.01 |
| Coupler dispersion medium (Cpd-6) | 0.05 |
| Coupler solvent (mixture of Solv-4, 6) | |

-continued

| | |
|---|---|
| The eight layer (Yellow filter layer) | |
| Yellow colloidal silver | 0.15 |
| Gelatin | 1.00 |
| Color stain inhibitor (Cpd-7) | 0.06 |
| Color stain inhibitor solvent mixture of Solv-4, 5 in the ratio of 1:1) | 0.15 |
| Polymer latex (Cpd-8) | 0.10 |
| The ninth layer (Low blue sensitive layer) | |
| Silver chloroiodobromide spectrally sensitized with blue sensitizing dye (mixture of ExS-5, 6 in the ratio of 1:1) [silver chloride: 2 mole %; silver iodide: 2.5 mole %; mean grain size: 0.38 μm; size distribution: 8%; cubic; iodine core-type core shell] | 0.06 |
| Silver iodobromide spectrally sensitized with blue sensitizing dye (mixture of ExS-5, 6 in the ratio of 1:1) [silver iodide: 2.5 mole %; mean grain size: 0.55 μm; size distribution: 11%; cubic] | 0.07 |
| Gelatin | 0.50 |
| Yellow coupler (mixture of ExY-1, 2 in the ratio of 1:1) | 0.20 |
| Stain inhibitor (Cpd-5) | 0.001 |
| Discoloration inhibitor (Cpd-14) | 0.10 |
| Coupler dispersion medium (Cpd-6) | 0.05 |
| Coupler solvent (Solv-2) | 0.05 |
| The tenth layer (High blue sensitive layer) | |
| Silver iodobromide spectrally sensitized with blue sensitizing dye (mixture of ExS-5, 6 in the ratio of 1:1) [silver iodide: 2.5 mole %; mean grain size: 1.4 μm; size distribution: 21%; tabular (aspect ratio = 14)] | 0.17 |
| Gelatin | 1.00 |
| Yellow coupler (mixture of ExY-1, 2 in the ratio of 1:1) | 0.40 |
| Stain inhibitor (Cpd-5) | 0.002 |

-continued

| | |
|---|---|
| Discoloration inhibitor (Cpd-14) | 0.10 |
| Coupler dispersion medium (Cpd-6) | 0.15 |
| Coupler solvent (Solv-2) | 0.10 |
| The eleventh layer (Ultraviolet absoring layer) | |
| Gelatin | 1.50 |
| Ultraviolet absorbent (mixture of Cpd-1, 2, 4, 15 in the ratio of 1:1:1:1) | 1.00 |
| Color stain inhibitor (mixture of Cpd-7, 16) | 0.06 |
| Dispersion medium (Cpd-6) | |
| Ultraviolet absorbent solvent (mixture of Solv-1, 2 in the ratio of 1:1) | 0.15 |
| Irradiation inhibiting dye (mixture of Cpd-17, 18 in the ratio of 1:1) | 0.02 |
| Irradiation inhibiting dye (mixture of Cpd-19, 20 in the ratio of 1:1) | 0.02 |
| The twelfth layer (Protective layer) | |
| Fine grains of silver chlorobromide [silver chloride: 97 mole %; mean grain size: 0.2 μm] | 0.04 |
| Modified POVAL | 0.02 |
| Gelatin | 1.50 |
| Gelatin hardening agent (mixture of H-1, 2 in the ratio of 1:1) | 0.17 |

Further, emulsifying dispersion aids of Alkanol XC (Trade name: Du Pont) and sodium alkylbenzen sulfonate, and coating aids of succinic acid ester and Magefac F120 (Trade name: Dainippon Ink & Chemicals Inc.) were also added to each layer. Stabilizers of Cpd-21, 22 and 23 were added to each of the layers containing silver halide or collodial silver.

Followings are compounds used for preparation of the photographic material.

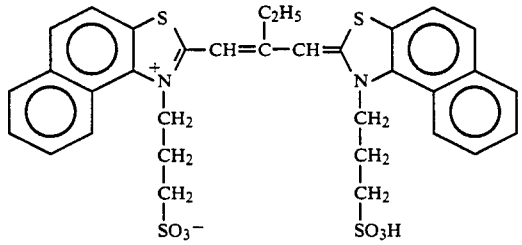

(ExS-1)

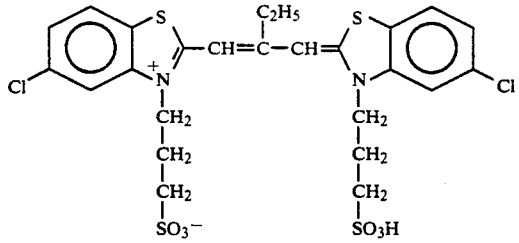

(ExS-2)

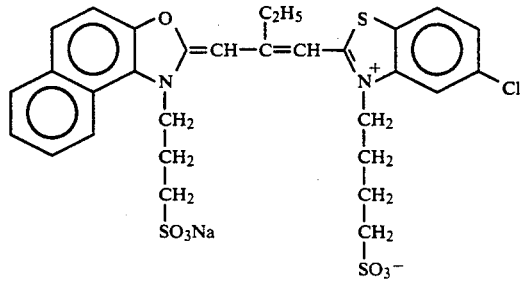

(ExS-3)

-continued
(ExS-4)
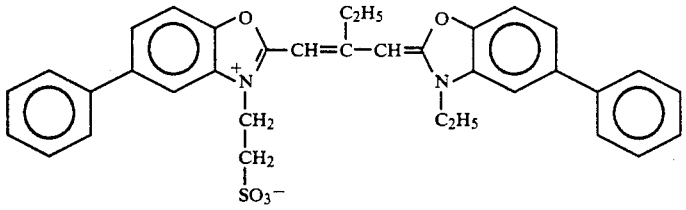
(ExS-5)
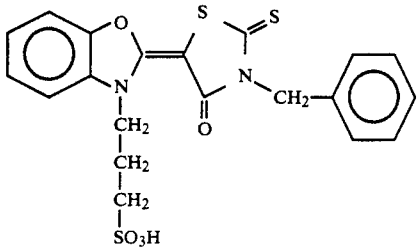
(ExS-6)
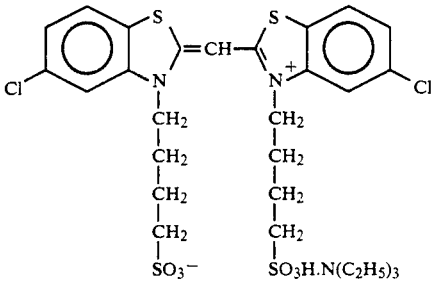
(Cpd-1)
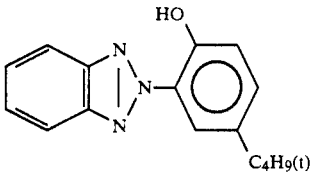
(Cpd-2)
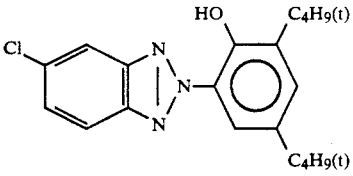
(Cpd-3)
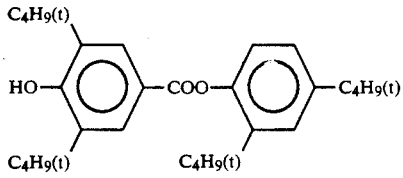
(Cpd-4)
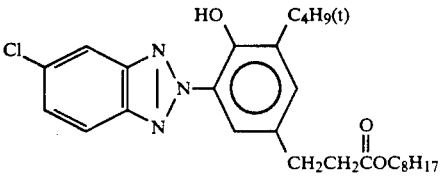

-continued
(Cpd-5)
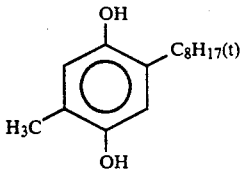
(Cpd-6)
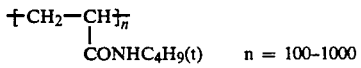
(Cpd-7)
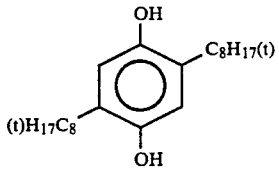
Polyethyl acrylate (MW = 10,000–100,000) (Cpd-8)
(Cpd-9)
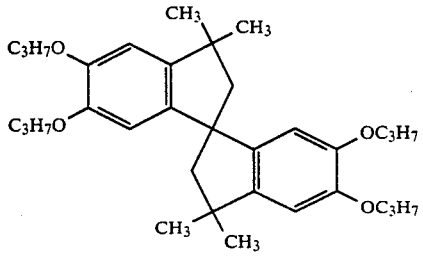
(Cpd-10)
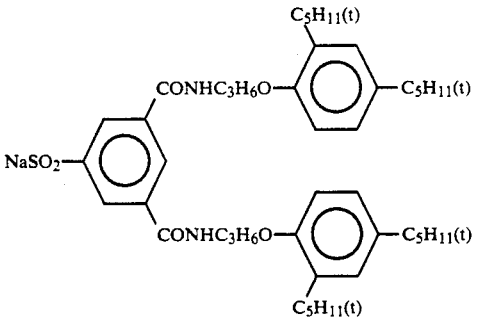
(Cpd-11)
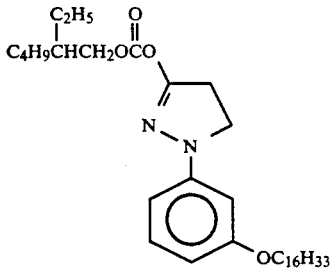
(Cpd-12)
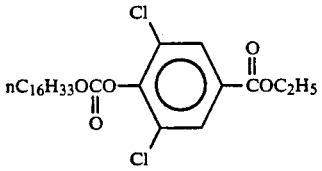

-continued
(Cpd-13)
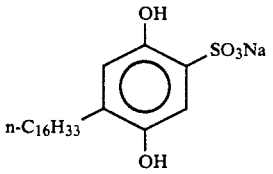
(Cpd-14)
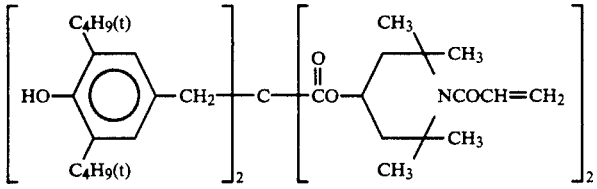
(Cpd-15)
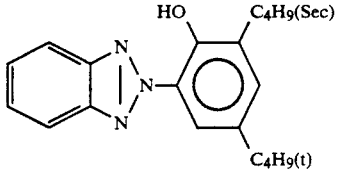
(Cpd-16)
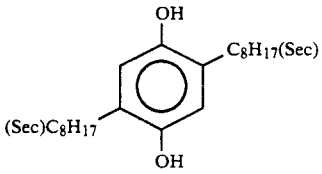
(Cpd-17)
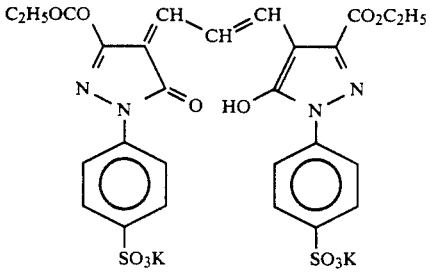
(Cpd-18)
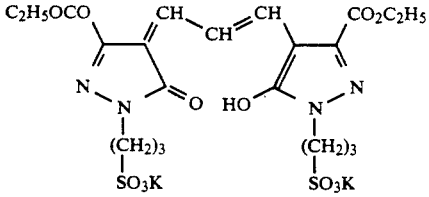
(Cpd-19)
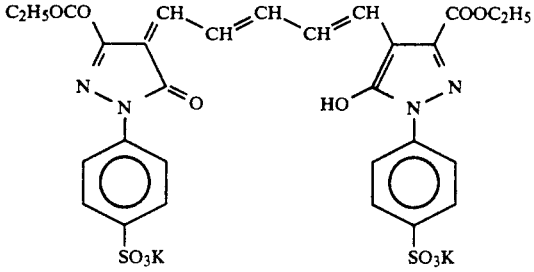

-continued
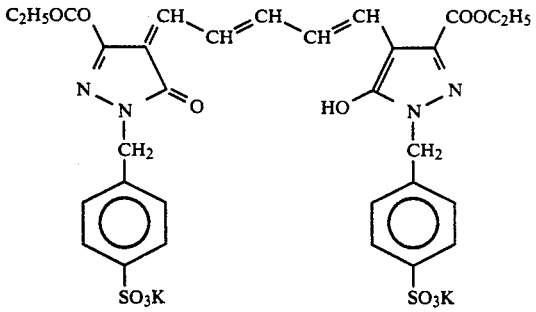
(Cpd-20)
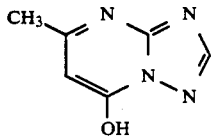
(Cpd-21)
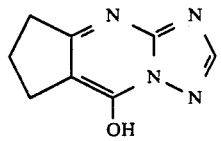
(Cpd-22)
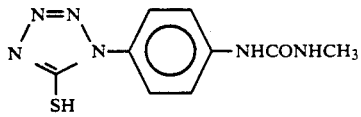
(Cpd-23)
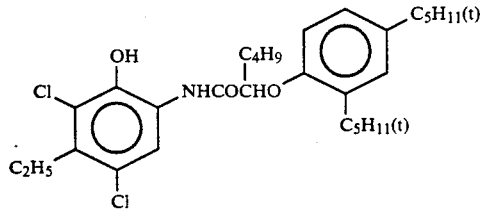
(ExC-1)
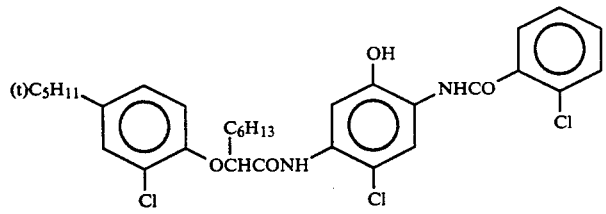
(ExC-2)
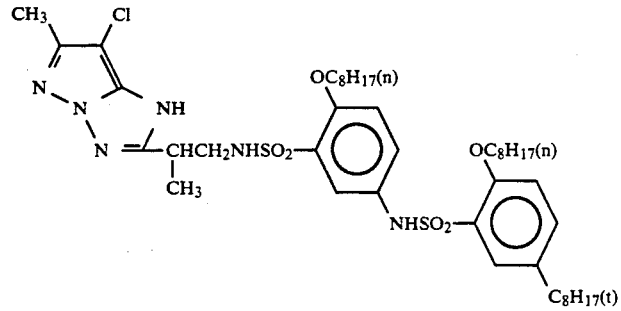
(ExM-1)

-continued (ExM-2)

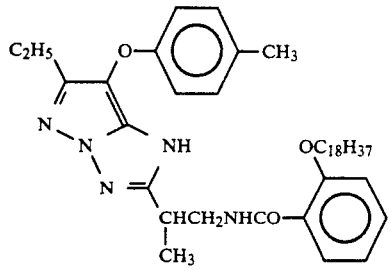

(ExY-1)

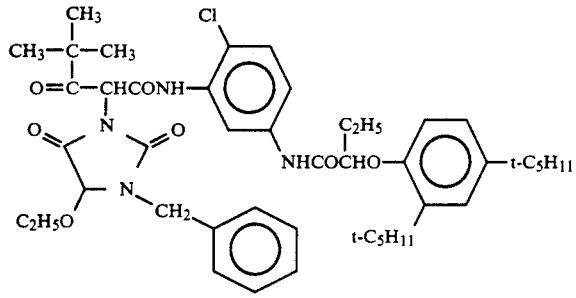

(ExY-2)

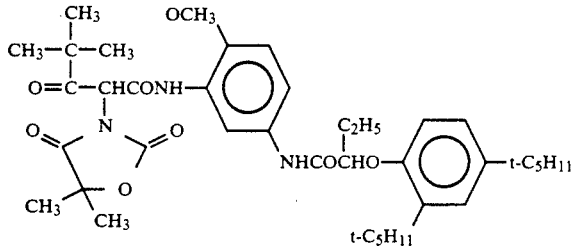

| | |
|---|---|
| Di(2-ethylhexyl) phthalate | (Solv-1) |
| Trinonyl phosphate | (Solv-2) |
| Di(3-methylhexyl) phthalate | (Solv-3) |
| Tricresyl phosphate | (Solv-4) |
| Dibutyl phthalate | (Solv-5) |
| Trioctyl phosphate | (Solv-6) |
| $CH_2{=}CH{-}SO_2{-}CH_2{-}CONH{-}CH_2{-}CH_2{-}CONH{-}CH_2{-}SO_2{-}CH{=}CH_2$ | (H-1) |
| Sodium salt of 4,6-dichloro-2-hydroxy-1,3,5-triazine | (H-2) |

The procedure of preparation of No. 101 was repeated except that the amount of the black collodial silver contained in the second layer (antihalation layer) was changed from 0.10 g/m$^2$ to 0.05 g/m$^2$ and the magenta collodial silver contained in the fifth layer (intermediate layer) was removed, to prepare a sample of No. 102. The total silver content of the sample No. 102 was 1.0 g/m$^2$.

Samples No. 103 to 110 were prepared in the same manner as in preparation of the sample No. 102 except that the compounds set forth in Table 1 were added to the photographic material.

Further, sample No. 111 was prepared in the same manner as in preparation of the sample No. 102 except that the amount of silver contained in each of the light-sensitive layers (the third, fourth, sixth, seventh, ninth and tenth layers) was reduced to 90%. The total silver content of the sample No. 111 was 0.92 g/m$^2$.

Samples No. 112 to 118 were prepared in the same manner as in preparation of the sample No. 111 except that the compounds set forth in Table 1 were added to the photographic material.

The following comparative compound (A) was used to be compared with the compound represented by the formula (1a) or (1b).

(A)

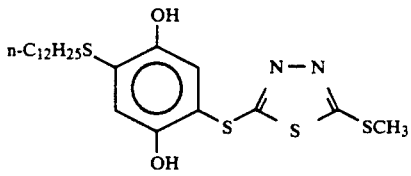

Each of the samples was exposed to white light through a pattern for measurement of sharpness, and then subjected to the following process.

Process

-continued

| | | |
|---|---|---|
| First development (black and white development) | 38°C. | 75 seconds |
| Washing | 38° C. | 90 seconds |
| Reversal exposure | 100 lux or more | 10 seconds or more |
| Color development | 38° C. | 135 seconds |
| Washing | 38° C. | 45 seconds |
| Bleach-fix | 38° C. | 120 seconds |
| Washing | 38° C. | 135 seconds |
| Drying | | |

Composition of processing liquid

| | |
|---|---|
| (First developing solution) | |
| Pentasodium nitrilo-N,N,N-trimethylenephosphonate | 0.6 g |
| Pentasodium diethylenetriaminepentaacetate | 4.0 g |
| Potassium sulfite | 30.0 g |
| Potassium thiocyanate | 1.2 g |
| Potassium carbonate | 35.0 g |
| Potassium hydroquinonemonosulfonate | 25.0 g |
| Diethylene glycol | 15.0 ml |
| 1-Phenyl-4-hydroxymethyl-4-methyl-3-pyrazolidone | 2.0 g |
| Potassium chloride | 0.5 g |
| Potassium iodide | 5.0 mg |
| Water | to make up to 1 l (pH: 9.70) |
| (Color developing solution) | |
| Benzyl alcohol | 15.0 ml |
| Diethylene glycol | 12.0 ml |
| 3,6-Dithia-1,8-octanediol | 0.2 g |
| Pentasodium nitrilo-N,N,N-trimethylenephosphonate | 0.5 g |
| Pentasodium diethylenetriaminepentaacetate | 2.0 g |
| Sodium sulfite | 2.0 g |
| Potassium carbonate | 25.0 g |
| Hydoxylaminesulfate | 3.0 g |
| N-ethyl-N-(β-methanesulfonamideethyl)-3-methyl-4-aminoanilinesulfate | 5.0 g |
| Potassium bromide | 0.5 g |
| Potassium iodide | 1.0 mg |
| Water | to make up to 1 l (pH: 10.40) |
| (Bleach-fix bath) | |
| 2-Mercapto-1,3,4-triazole | 1.0 g |
| Disodium ethylenediaminetetraacetate dihydrate | 5.0 g |
| Ammonium ethylenediaminetetraacetate Fe(III) monohydrate | 80.0 g |
| Sodium sulfite | 15.0 g |
| Sodium thiosulfate (700 g/l liquid) | 160.0 ml |
| Glacial acetic acid | 5.0 ml |
| Water | to make up to 1 l (pH: 6.50) |

The sharpness of the cyan image and the magenta image formed by each of the samples was measured.

The sharpness was measured as a MTF value. The MTF value at frequency of 10 per 1 mm is set forth in Table 1. MTF is described in T. H. James, The Theory of the Photographic Process, 1977, Macmillan, pp.592–618

Next, each of the samples was exposed to red light through a continuous filter, and then subjected to the developing process as is mentioned above. Subsequently, each of the samples No. 101 to 118 was exposed to white light (red light+green light+blue light) adjusting the three lights through continuous filter in such a manner that the developed sample became gray, and then subjected to the same developing process. The light amount of the red light in the red light exposure was the same as that of the red light in the white light exposure. Thus developed each sample was measured in the density, and the difference of the light amount between in the red light exposure and in the white light exposure in the case that the cyan density was 0.6 was determined as the inter image effect for the red sensitive silver halide emulsion layer, namely ΔlogE (R). Likewise, the inter image effect for the green sensitive silver halide emulsion layer, namely, ΔlogE (G), was determined. The results are set forth in Table 1.

In Table 1, as the value of ΔlogE (R) or ΔlogE (G) becomes larger, the inter image effect of higher level can be obtained, that is, such color photographic material exhibits a color reproducibility of high saturation.

As is evident from Table 1, the sample No. 102 in which the amount of the colloidal silver contained in the second layer (antihalation layer) and the fifth layer (intermediate layer) shows a low sharpness and a weak inter image effect compared with the sample No. 101. Further, the sample No. 111 in which the amount of the silver is more reduced shows a very weak inter image effect.

On the other hands, the samples of the present invention containing the compound represented by the formula (1a) or (1b) gives a clear image having a high sharpness and a strong image image effect even if the amount of silver is small. This effect was not obtained by the sample using the comparative compound (A).

Further, the samples of the present invention quickly formed the clear image.

TABLE 1

| Sample No. | Amount of Silver ($g/m^2$) | Compound | Added Layer | Amount in each Layers ($mole/m^2$) |
|---|---|---|---|---|
| 101* | 1.1 | — | — | — |
| 102* | 1.0 | — | — | — |
| 103* | 1.0 | (A) | 5 | $5 \times 10^{-5}$ |
| 104 | 1.0 | (1a-12) | 5 | $5 \times 10^{-5}$ |
| 105 | 1.0 | (1a-13) | 5 | $5 \times 10^{-5}$ |
| 106 | 1.0 | (1b-5) | 5 | $5 \times 10^{-5}$ |
| 107* | 1.0 | (A) | 3, 4 | $2 \times 10^{-5}$ |
| 108 | 1.0 | (1a-12) | 3, 4 | $2 \times 10^{-5}$ |
| 109* | 1.0 | (A) | 3, 4, 6, 7 | $2 \times 10^{-5}$ |
| 110 | 1.0 | (1a-12) | 3, 4, 6, 7 | $2 \times 10^{-5}$ |
| 111* | 0.92 | — | — | — |
| 112* | 0.92 | (A) | 3, 4, 6, 7 | $2 \times 10^{-5}$ |
| 113 | 0.92 | (1a-3) | 3, 4, 6, 7 | $2 \times 10^{-5}$ |
| 114 | 0.92 | (1a-12) | 3, 4, 6, 7 | $2 \times 10^{-5}$ |
| 115 | 0.92 | (1a-13) | 3, 4, 6, 7 | $2 \times 10^{-5}$ |
| 116 | 0.92 | (1a-19) | 3, 4, 6, 7 | $2 \times 10^{-5}$ |
| 117 | 0.92 | (1a-29) | 3, 4, 6, 7 | $2 \times 10^{-5}$ |
| 118 | 0.92 | (1b-5) | 3, 4, 6, 7 | $2 \times 10^{-5}$ |

| Sample | MTF (10 C/mm) | | Inter Image Effect | | |
|---|---|---|---|---|---|
| No. | Cyan | Magenta | ΔlogE(R) | ΔlogE(G) | ΔlogE(B) |
| 101* | 0.55 | 0.70 | 0.13 | 0.18 | 0.12 |
| 102* | 0.44 | 0.57 | 0.10 | 0.13 | 0.09 |
| 103* | 0.45 | 0.57 | 0.10 | 0.13 | 0.09 |
| 104 | 0.50 | 0.64 | 0.19 | 0.26 | 0.16 |
| 105 | 0.49 | 0.63 | 0.18 | 0.24 | 0.15 |
| 106 | 0.49 | 0.62 | 0.18 | 0.23 | 0.15 |
| 107* | 0.46 | 0.58 | 0.10 | 0.13 | 0.09 |
| 108 | 0.56 | 0.72 | 0.14 | 0.28 | 0.17 |
| 109* | 0.46 | 0.58 | 0.10 | 0.13 | 0.09 |
| 110 | 0.57 | 0.73 | 0.23 | 0.30 | 0.21 |
| 111* | 0.49 | 0.62 | 0.07 | 0.09 | 0.06 |
| 112* | 0.50 | 0.63 | 0.07 | 0.09 | 0.06 |
| 113 | 0.59 | 0.75 | 0.14 | 0.20 | 0.13 |
| 114 | 0.60 | 0.66 | 0.17 | 0.23 | 0.16 |
| 115 | 0.58 | 0.75 | 0.15 | 0.22 | 0.15 |
| 116 | 0.58 | 0.74 | 0.14 | 0.21 | 0.14 |
| 117 | 0.57 | 0.73 | 0.14 | 0.20 | 0.13 |
| 118 | 0.55 | 0.72 | 0.13 | 0.20 | 0.13 |

Remark: The mark (*) means the comparative samples.

EXAMPLE 2

The procedure of preparation of the sample No. 101 in Example 1 was repeated to prepare a sample No. 201.

A solution of 10 g of the compound (1a-3), 50 g of oil (solv-5), 50 g of ethyl acetate and 10 g of sodium alkylbenzenesulfonate was prepared while heating. The solution was added to 1,000 g of gelatin solution and the resulting mixuture was stirred in a mixer to prepare an emulsion. A sample No. 202 was prepared in the same manner as in preparation of the sample No. 201, except that the above-prepared emulsion was added to the third layer (low red sensitive layer).

The sample No. 203 was prepared in the same manner as in preparation of the sample No. 202, except that the compound (1a-12) was used in place of the compound (1a-3).

The sample No. 204 was prepared in the same manner as in preparation of the sample No. 202, except that the compound (1b-5) was used in place of the compound (1a-3).

A solution of 10 g of the compound (1a-3), 10 g of the polymer (P-12), 50 g of oil (solv-5), 50 g of ethyl acetate and 10 g of sodium alkylbenzenesulfonate was prepared while heating. The solution was added to 1,000 g of gelatin solution and the resulting mixuture was stirred in a mixer to prepare an emulsion. A sample No. 205 was prepared in the same manner as in preparation of the sample No. 201, except that the above-prepared emulsion was added to the third layer (low red sensitive layer).

The sample No. 206 was prepared in the same manner as in preparation of the sample No. 205, except that the compound (1a-12) was used in place of the compound (1a-3).

The sample No. 207 was prepared in the same manner as in preparation of the sample No. 206, except that the polymer (P-33) was used in place of the polymer (P-12).

The sample No. 208 was prepared in the same manner as in preparation of the sample No. 206, except that the polymer (P-61) was used in place of the polymer (P-12).

Each of the samples No. 201 to No. 208 was exposed to white light through a pattern for measurement of sharpness, and then subjected to the process in the same manner as in Example 1.

The sharpness of the obtained cyan image was measured in the same manner as in Example 1. The MTF value through a red filter at frequency of 10 per 1 mm is set forth in Table 2.

Further, each of the samples was preserved under the following conditions.

| Condition | Temperature | Humidity | Term |
|---|---|---|---|
| 1 | 50° C. | 30% | 3 days |
| 2 | 45° C. | 80% | 3 days |

-continued

| Condition | Temperature | Humidity | Term |
|---|---|---|---|
| 3 | 5° C. (in refrigerator) | | 3 days |

Each of the samples was exposed to light through a continuous filter, and then subjected to the developing process in the same manner as in Example 1. The density of the obtained image was measured through a red filter. Then the following values were obtained.

| | |
|---|---|
| Δ Dmax = | (Maximum density of the sample preserved under the condition 3) − (Maximum density of the sample preserved under the condition 1 or 2) |
| Δ $S_{0.5}$ = | (the sensitivity (log E) at the density of 0.5 of the sample preserved under the condition 3) − (the sensitivity (log E) at the density of 0.5 of the sample preserved under the condition 1 or 2) |

The results are set forth in Table 2.

The small values of ΔDmax and $\Delta S_{0.5}$ are preferred.

As is evident from Table 2, the samples using the polymer are improved in the preservability. In other words, the Dmax and the sensitivity of these samples are not degraded even if the samples are preserved under severe conditions.

TABLE 2

| | Compound | | Polymer | | Sharp | Condition 1 | | Condition 2 | |
|---|---|---|---|---|---|---|---|---|---|
| No. | Kind | mg/m² | kind | mg/m² | ness | $\Delta D_{max}$ | $\Delta S_{0.5}$ | $\Delta D_{max}$ | $\Delta S_{0.5}$ |
| 201 | — | — | — | — | 0.49 | 0.02 | 0.01 | 0.06 | −0.02 |
| 202 | 1a-3 | 5 | — | — | 0.54 | 0.15 | −0.06 | 0.23 | −0.11 |
| 203 | 1a-12 | 5 | — | — | 0.57 | 0.16 | −0.06 | 0.22 | −0.10 |
| 204 | 1b-5 | 5 | — | — | 0.55 | 0.14 | −0.07 | 0.23 | −0.11 |
| 205 | 1a-3 | 5 | P-12 | 5 | 0.57 | 0.02 | 0.00 | 0.05 | −0.01 |
| 206 | 1a-12 | 5 | P-12 | 5 | 0.61 | 0.01 | 0.01 | 0.06 | −0.02 |
| 207 | 1a-12 | 5 | P-33 | 5 | 0.60 | 0.02 | −0.01 | 0.07 | −0.01 |
| 208 | 1a-12 | 5 | P-61 | 5 | 0.60 | 0.02 | 0.01 | 0.05 | −0.02 |

EXAMPLE 3

The sample No. 301 was prepared in the same manner as in preparation of the sample No. 201 in Example 2, except that the coating solution of the third layer (low red sensitive layer) was preserved at 40° C. for 8 hours in a thermostat.

The sample No. 302 was prepared in the same manner as in preparation of the sample No. 202 in Example 2, except that the coating solution of the third layer (low red sensitive layer) was preserved at 40° C. for 8 hours in a thermostat.

The sample No. 303 was prepared in the same manner as in preparation of the sample No. 302, except that the compound (1a-12) was used in place of the compound (1a-3).

The sample No. 304 was prepared in the same manner as in preparation of the sample No. 302, except that the compound (1b-5) was used in place of the compound (1a-3).

The sample No. 305 was prepared in the same manner as in preparation of the sample No. 205 in Example 2, except that the coating solution of the third layer (low red sensitive layer) was preserved at 40° C. for 8 hours in a thermostat.

The sample No. 306 was prepared in the same manner as in preparation of the sample No. 305, except that the compound (1a-12) was used in place of the compound (1a-3).

The sample No. 307 was prepared in the same manner as in preparation of the sample No. 306, except that the polymer (P-33) was used in place of the polymer (P-12).

The sample No. 308 was prepared in the same manner as in preparation of the sample No. 306, except that the polymer (P-61) was used in place of the polymer (P-12).

Each of the samples No. 301 to No. 308 was exposed to white light through a pattern for measurement of sharpness, and then subjected to the process in the same manner as in Example 1.

The sharpness of the obtained cyan image was measured in the same manner as in Example 2. The MTF value through a red filter at frequency of 10 per 1 mm is set forth in Table 3.

Each of the samples was exposed to light through a continuous filter, and then subjected to the developing process in the same manner as in Example 2. The density of the obtained image was measured through a red filter. Then the following values were obtained.

| | |
|---|---|
| Δ Dmax = | (Maximum density of the sample using the coating solution immediately after the preparation) − (Maximum density of the sample using a coating solution preserved at 40° C. for 8 hours) |
| Δ $S_{0.5}$ = | (the sensitivity (log E) at the density of 0.5 of the sample using the coating solution immediately after the preparation) − (the sensitivity (log E) at the density of 0.5 of the sample using a coating solution preserved at 40° C. for 8 hours) |

The results are set forth in Table 3.

The small values of ΔDmax and $\Delta S_{0.5}$ are preferred.

As is evident from Table 3, the samples using the polymer are improved in the preservability of the coating solution. In other words, the Dmax and the sensitivity of these samples are not degraded even if the coating solutions are preserved under severe conditions.

TABLE 3

| Sample | Compound | | Polymer | | Sharp- | | |
|---|---|---|---|---|---|---|---|
| No. | Kind | mg/m² | Kind | mg/m² | ness | $\Delta D_{max}$ | $\Delta S_{0.5}$ |
| 301 | — | — | — | — | 0.47 | 0.01 | −0.01 |
| 302 | 1a-3 | 5 | — | — | 0.53 | 0.13 | −0.07 |
| 303 | 1a-12 | 5 | — | — | 0.55 | 0.11 | −0.08 |
| 304 | 1b-5 | 5 | — | — | 0.53 | 0.10 | −0.07 |
| 305 | 1a-3 | 5 | P-12 | 5 | 0.54 | 0.02 | −0.02 |
| 306 | 1a-12 | 5 | P-12 | 5 | 0.57 | 0.01 | −0.01 |
| 307 | 1a-12 | 5 | P-33 | 5 | 0.56 | 0.01 | −0.01 |
| 308 | 1a-12 | 5 | P-61 | 5 | 0.55 | 0.01 | −0.02 |

EXAMPLE 4

Samples were prepared and evaluated in the same manner as in Example 2, except that the compound and the polymer were added to the sixth layer (low green sensitive layer) in place of the third layer (low red sensitive layer). As a result, similar effects were obtained in the photographic material of the present invention.

We claim:

1. A silver halide color photographic material comprising a support, a blue sensitive layer, a green sensitive layer and a red sensitive layer, wherein the total silver content of the photographic material is not more than 1.0 g/m², and the photographic material further contains a compound represented by the formula (1a) or (1b):

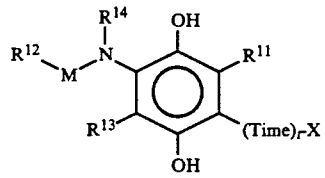

(1a)

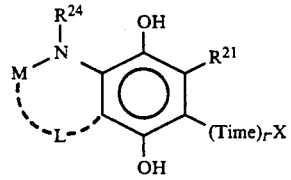

(1b)

in which $R^{12}$ is an aliphatic group, an aromatic group or a heterocyclic group; M is —N($R^{15}$)CO—, —OCO— or —N($R^{15}$)$SO_2$—; each of $R^{14}$, $R^{15}$ and $R^{24}$ independently is hydrogen, an alkyl group or an aryl group; L is a divalent linking group necessary for forming a 5, 6 or 7-membered ring; each of $R^{11}$, $R^{13}$ and $R^{21}$ independently is hydrogen or a substituent group of the hydroquinone nucleus; Time is a group which is released from the oxidation product of the hydroquinone nucleus to further release X; X is a development inhibitor; and t is 0 or 1.

2. The photographic material as claimed in claim 1, wherein the compound represented by the formula (1a) or (1b) is contained in at least one of the blue, green and red sensitive layers.

3. The photographic material as claimed in claim 1, wherein the compound represented by the formula (1a) or (1b) is contained in the photographic material in an amount of 0.001 mmol/m² to 0.2 mmol/m².

4. The photographic material as claimed in claim 1, wherein the photographic material is a color reversal sensitive material.

* * * * *